US005534389A

United States Patent [19]

Arai et al.

[11] Patent Number: 5,534,389

[45] Date of Patent: Jul. 9, 1996

[54] PROCESSING METHOD OF BLACK-AND-WHITE LIGHT-SENSITIVE SILVER HALIDE PHOTOGRAPHIC MATERIAL AND PROCESSING AGENT FOR THE SAME

[75] Inventors: Takeo Arai; Tadashi Sekiguchi; Takeshi Habu; Shiyouji Nishio; Hiroyuki Usiroyama; Kenichi Tanaka; Akira Kobayashi, all of Hino, Japan

[73] Assignee: Konica Corporation, Tokyo, Japan

[21] Appl. No.: 272,270

[22] Filed: Jul. 8, 1994

Related U.S. Application Data

[63] Continuation of Ser. No. 888,876, May 26, 1992, abandoned.

[30] Foreign Application Priority Data

May 31, 1991 [JP] Japan ..... 3-129389
Jul. 18, 1991 [JP] Japan ..... 3-178438

[51] Int. Cl.[6] ..... G03C 3/00; G03C 5/18; G03C 5/26; G03C 5/38

[52] U.S. Cl. ..... 430/401; 430/264; 430/398; 430/399; 430/400; 430/438; 430/439; 430/458; 430/465

[58] Field of Search ..... 430/264, 398, 430/399, 400, 401, 450, 458, 465, 438, 439

[56] References Cited

U.S. PATENT DOCUMENTS

| | | | |
|---|---|---|---|
| 2,685,516 | 8/1954 | Wilson | 430/465 |
| 4,816,384 | 3/1989 | Fruge et al. | 430/465 |
| 4,978,602 | 12/1990 | Fujita et al. | 430/264 |
| 4,987,060 | 1/1991 | Marchesano | 430/465 |
| 5,055,384 | 10/1991 | Kühnert | 430/465 |
| 5,085,970 | 2/1992 | Kameoka et al. | 430/264 |
| 5,153,098 | 10/1992 | Takagi | 430/264 |
| 5,270,154 | 12/1993 | Kim et al. | 430/458 |
| 5,328,814 | 7/1994 | Kim et al. | 430/458 |
| 5,405,732 | 4/1995 | Shimizu et al. | 430/465 |
| 5,460,926 | 10/1995 | Komatsu et al. | 430/465 |

FOREIGN PATENT DOCUMENTS

| | | |
|---|---|---|
| 0204372 | 12/1986 | European Pat. Off. . |
| 0316864 | 5/1989 | European Pat. Off. . |
| 1472777 | 3/1969 | Germany . |

*Primary Examiner*—Charles L. Bowers, Jr.
*Assistant Examiner*—J. Pasterczyk
*Attorney, Agent, or Firm*—Frishauf, Holtz, Goodman, Langer & Chick

[57] ABSTRACT

Disclosed are a method for processing a black-and-white light-sensitive silver halide photographic material containing at least one kind of a tetrazolium compound or a hydrazine compound with a developing solution containing a polyhydroxybenzene type developing agent, wherein the developing solution is a developing solution prepared by using a solid processing agent, a solid processing agent for a black-and-white light-sensitive silver halide photographic material containing a tetrazolium compound or a hydrazine compound comprising a polyhydroxybenzene type developing agent and a solid processing agent for a black-and-white light-sensitive silver halide photographic material containing a tetrazolium compound or a hydrazine compound comprising a thiosulfate fixing agent and water in an amount of 300% or less based on an amount of the thiosulfate fixing agent.

12 Claims, No Drawings

PROCESSING METHOD OF BLACK-AND-WHITE LIGHT-SENSITIVE SILVER HALIDE PHOTOGRAPHIC MATERIAL AND PROCESSING AGENT FOR THE SAME

This application is a Continuation, of application Ser. No. 07/888,876, filed May 26, 1992 (abandoned).

BACKGROUND OF THE INVENTION

This invention relates to a method for processing a black-and-white light-sensitive silver halide photographic material and a processing agent for the same, more specifically, it relates to processing method suitable for forming a high contrast black-and-white photographic image such as a line image and a screen image by using a light-sensitive silver halide photographic material containing a tetrazolium compound or a hydrazine compound.

In an automatic processor in which a light-sensitive photographic material is processed by developing, fixing and bleaching, a predetermined amount of a processing agent is required to be added to the processing solution in the processor, as a replenishing solution to replace losses on the light sensitive material being processed or through evaporation oxidation and deterioration of the processing solution. It is usual that such a replenishing agent is provided in a concentrated liquid state and used by diluting with water.

Among photographic processing agents, an acid or an alkali for controlling a pH or various kinds of buffers which control pH fluctuation are contained. Among additives contained in the processing agents, some of them cause a chemical reaction in the processing agent when pH fluctuates greatly to acidic or alkaline from the pH initially set as mentioned above whereby precipitates are found.

When a film containing a contrast increasing agent in order to improve particularly sharpness is to be processed, photographic characteristics such as sharpness, maximum density and fog are remarkably affected by stability of a processing solution when preparing it. In a liquid type photographic processing agent, it is stored in a concentrated liquid state so that activity of the processing agent is changed depending on the preservation conditions such as preservation temperature. When such a processing solution is used as a replenishing solution, photographic characteristics become unstable.

In such a situation, there is a demand for a processing method which gives constantly stable photographic characteristics.

Also, processing of a light-sensitive silver halide photographic material which had been subjected to image wise exposure has heretofore been carried out, in general, by using an automatic processor and applying processing including development and fixing whereby a photographic image can be obtained. In the processing using an automatic processor, it is known to replenish the activity and lost volume of the processing solutions caused by processing light sensitive materials or by evaporation or oxidation due to air. The replenishing agent to be used for such a replenishment has been sold as a concentrated solution, and used for replenishing by diluting with water before use. Such a running processing using an automatic processor has been carried out without causing any specific problem.

However, when a light-sensitive silver halide photographic material containing a tetrazolium compound or a hydrazine compound is to be developed by a developing solution containing a polyhydroxybenzene type developing agent, the present inventors have found that deterioration in finished quality, more specifically deterioration in sharpness of image occurred with the progress of the running processing, and such a phenomenon becomes more marked in a processing in which a supplementing amount is reduced in order to reduce an amount of a photographic waste liquor or in a rapid processing.

Particularly in a light-sensitive material containing a hydrazine compound, there is a problem that sand-like fog, i.e. the so-called black dot, occurred at an unexposed portion after development processing deteriorates. Also, in a light-sensitive material containing a tetrazolium compound, a problem of occurrence of pin-holes at a blackening portion arises. Also, when a light-sensitive material containing the hydrazolium compound or tetrazolium compound is processed, it sometimes causes fluctuation in sharpness of an image, and a means for overcoming these problems has not yet been found.

The present inventors have also found that, in a fixing solution, there is a problem of causing deterioration in processing quality, more specifically fixation failure and drying failure whereas they are less significant than that of a developing solution.

SUMMARY OF THE INVENTION

In view of the above problems, an object of the present invention is to provide a black-and-white light-sensitive silver halide photographic material which can be easily processed within a short time, excellent in stability at or after preparation of a solution and excellent in maximum density, sharpness and fog prevention, and a method for processing the same.

Also, another object of the present invention is to provide a processing method improved in stability of finished qualities when processing a light-sensitive silver halide photographic material containing a tetrazolium compound or a hydrazine compound by applying a supplementing system using an automatic processor.

It is also an object of the present invention to provide a processing method improved in stability of finished qualities when developing with a developing solution containing a polyhydroxybenzene type developing agent.

A further object of the present invention is to provide a processing method improved in stability of fixing quality.

A still further object of the present invention is to provide a developing solution for a light-sensitive silver halide photographic material containing a tetrazolium compound or a hydrazine compound, which improves stability of finished qualities when processing the material using an automatic processer by a replenishing system.

A further object of the present invention is to provide a fixing solution for a light-sensitive silver halide photographic material containing a tetrazolium compound or a hydrazine compound, which improves stability of finished qualities when processing the material using an automatic processer by a replenishing system.

The constitutions of the present invention which accomplish the above objects are the following (1) to (9).

(1) In a method for processing a light-sensitive silver halide photographic material containing at least one kind of a tetrazolium compound or a hydrazine compound with a developing solution containing a polyhydroxybenzene type developing agent, the improvement wherein said developing solution is a developing solution prepared by using a solid processing agent.

(2) The processing method of the above (1), wherein said solid processing agent is stored in the state that an amount of water is 2000% or less based on the amount of polyhydroxybenzene type developing agent.

(3) The processing method of the above (1), wherein said solid processing agent contains at least one selected from the group consisting of 1-phenyl-3-pyrazolidone or a derivative thereof, and N-methyl-p-aminophenol sulfate or a derivative thereof.

(4) A method for processing a light-sensitive silver halide photographic material which comprises processing a light-sensitive silver halide photographic material containing at least one kind of a tetrazolium compound or a hydrazine compound with a fixing solution containing thiosulfate fixing agent prepared by using a solid processing agent.

(5) The processing method of the above (4), wherein said solid processing agent is a solid material stored in the state that an amount of water is 300% or less based on the amount of a thiosulfate fixing agent.

(6) A solid processing agent for a light-sensitive silver halide photographic material containing a tetrazolium compound or a hydrazine compound which comprises a polyhydroxybenzene type developing agent.

(7) The solid processing agent of the above (6), wherein an amount of water based on the polyhydroxybenzene type developing agent is 2000% or less.

(8) The solid processing agent of the above (6) or (7), wherein the agent contains at least one kind selected from a 1-phenyl-3-pyrazolidone compound and N-methyl-p-aminophenol compound.

(9) A solid processing agent for a light-sensitive silver halide photographic material containing a tetrazolium compound or a hydrazine compound which comprises water in an amount of 300% or less based on an amount of a thiosulfate fixing agent.

(10) A method of of the above (1), wherein the black-and-white light-sensitive silver halide photographic material is further processed by a fixing solution prepared by using a solid processing agent.

(11) In a method for processing a light-sensitive silver halide photographic material containing at least one kind of a tetrazolium compound with a developing solution containing a polyhydroxybenzene type developing agent, the improvement wherein said developing solution is used by diluting with a solvent containing at least water a raw solution which had been stored in a state that an amount of water being 400% or less based on the polyhydroxybenzene developing agent.

DESCRIPTION OF THE PREFERRED EMBODIMENTS

Solid of the solid processing agent to be used in the present invention refers to a general solid body including powder, granule, a tablet and paste, or a mixture thereof.

When the solid processing agent of the present invention is a solid processing agent to be used for preparing a black-and-white developing solution, it is preferred to contain a polyhydroxybenzene type developing agent in said solid processing agent in order to reduce the change in quality of the developing agent after it is packaged and before use. The water content of said solid developing agent in the above state is preferably 0.5% or more to 2000% or less based on an amount of the polyhydroxybenzene type developing agent.

Also, when the solid processing agent of the present invention is a solid processing agent to be used for preparing a fixing solution, it is preferred to contain a thiosulfate fixing agent in said solid processing agent in order to reduce the change in quality of the fixing agent during packaged state. The water content contained in said solid fixing agent in the above state is preferably 300% or less based on an amount of the thiosulfate fixing agent.

When the solid processing agent is a black-and-white developing solution, components to be contained in the solid processing agent are described below.

The developing agent to be used in the black-and-white developing solution used in the present invention is particularly preferably a combination of a dihydroxybenzene ring and 1-phenyl-3-pyrazolidones for the purpose of easily obtaining good characteristics. Of course, a p-aminophenol type developing agent may be additionally contained.

The dihydroxybenzene developing agent to be used in the present invention may include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, and particularly preferred is hydroquinone.

The 1-phenyl-3-pyrazolidone or a derivative thereof to be used as a developing agent in the present invention may include 1-phenyl-4,4-dimethyl-3-pyrazolidone, 1-phenyl-4-methyl- 4-hydroxymethyl-3-pyrazolidone and 1-phenyl-4,4-dihydroxymethyl- 3-pyrazolidone.

The p-aminophenol type developing agent to be used in the present invention may include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol, and among them, N-methyl-p-aminophenol is preferred.

The developing agent is generally used preferably in an amount of 0.01 mole/liter to 1.2 mole/liter.

As a sulfite to be used as a preservative in the present invention, there may be mentioned sodium sulfite, potassium sulfite, lithium sulfite, ammonium sulfite, sodium bisulfite, potassium metabisulfite and formaldehyde sodium bisulfite. The sulfite is preferably used in an amount of 0.2 mole/liter or more, particularly 0.4 mole/liter or more. The upper limit is preferably 2.5 mole/liter.

As a pH adjusting agent of the developing solution to be used in the present invention, an alkali agent and a pH buffer may be contained. An alkali agent used for adjusting pH may include pH controllers such as sodium hydroxide, potassium hydroxide, sodium carbonate, potassium carbonate, sodium tertiary phosphate and potassium tertiary phosphate.

A buffer such as borate disclosed in Japanese Provisional Patent Publication No. 28708/1986, saccharose, acetoxime or 5-sulfosalicylic acid disclosed in Japanese Provisional Patent Publication No. 93439/1985, phosphate and carbonate may be used.

Effects of the present invention, particularly inhibiting black dotting and improvement in sharpness when processing a light-sensitive material containing a hydrazine compound or inhibiting pin hole and improvement in sharpness when processing a light-sensitive material containing a tetrazolium compound is remarkable when the developing solution having a pH of 10 or more is used.

As an additive used in addition to the above components, there may be included a development inhibitor such as sodium bromide, potassium bromide and potassium iodide; an organic solvent such as ethylene glycol, diethylene glycol, triethylene glycol, dimethylformamide, methyl cellosolve, hexylene glycol, ethanol and methanol; and an antifoggant including a mercapto series compound such as 1-phenyl-5-mercaptotetrazole and sodium 2-mercaptobenzimidazole-5-sulfonate, an indazole series compound such as 5-nitroindazole, and a benztriazole series compound such as 5-methylbenztriazole, and further, a tone modifier, a surfactant, a defoaming agent, a hard water-softening agent and an amino compound disclosed in Japanese Provisional Patent Publication No. 106244/1981 may be contained, if necessary.

In the present invention, a silver stain preventive, for example, a compound disclosed in Japanese Provisional Patent Publication No. 24347/1981 may be used in the developing solution. In the developing solution of the present invention, an amino compound such as alkanolamine disclosed in Japanese Provisional Patent Publication No. 106244/1981 may be used. Other additives disclosed in F. A. Mason, "Photographic Processing Chemistry", published by Focal Press (1966), pp. 226 to 229, U.S. Pat. Nos. 2,193,015 and 2,592,364, and Japanese Provisional Patent Publication No. 64933/291973 may be also used.

The fixing agent may be sodium thiosulfate or ammonium thiosulfate, and an thiosulfuric acid ion and an ammonium ion are essential components. When considering fixing rate, ammonium thiosulfate is particularly preferred.

The amount of the fixing agent to be used varies suitably, and is generally about 0.1 to about 6 mole/liter.

In the fixing solution, a water-soluble aluminum salt which acts as a hardener may be contained, which includes, for example, aluminum chloride, ammonium sulfate and potassium alum.

In the fixing solution, tartaric acid, citric acid or a derivative thereof may be used alone or in combination of two or more. These compounds are effectively contained in an amount of 0.005 mole or more per liter of the fixing solution, particularly effectively 0.01 mole/liter to 0.03 mole/liter.

There may be mentioned specifically tartaric acid, potassium tartrate, sodium tartrate, potassium sodium tartrate, citric acid, sodium citrate, potassium citrate, lithium citrate and ammonium citrate.

In the fixing solution, a preservative (e.g. sulfite and bisulfite), a pH buffer (e.g. acetic acid and nitric acid), a pH controller (e.g. sulfuric acid) and a chelating agent having ability of softening hard water may be contained as desired.

Next, a method for preparing a solid processing agent is described below.

In a packaged form of the solid processing agent, the processing agent may be divided into two or more components and each component may be encapsulated in a kit for increasing storability of the processing agent in a kit.

A method for preparing a processing solution by using the solid processing agent is described below.

The solid processing agent of the present invention may be dissolved either manually or mechanically similarly as a conventional preparation of a liquid agent, and a replenishing tank may be either inside or outside an automatic processor. The processing agent may be supplied by any method so long as the respective components of the processing agent are not scattered, and there may be included, for example, a method in which the solid processing agent is wrapped in a water-soluble polymer film and thrown as such into a tank, and a method in which the processing agent is wrapped in a paper having a surface coated with, for example, polyethylene for preventing scattering and residue of powdered chemicals and added into a tank. In consideration of solubility of the processing agent to water, a form of a solid is preferably granule or a tablet. However, a substance slightly soluble in water is frequently contained in components of a processing agent for photographs. In that case, a slightly soluble substance is sometimes precipitated in a processing solution. For preventing this problem, a method of adding a solvent separately may be employed. For forming granule or a tablet, a granulating aid used in general is preferably used, and a polymer soluble in water, or soluble in alkali or acid is used. There may be used specifically one selected from gelatin, pectin, polyacrylic acid, polyacrylate, polyvinyl alcohol, polyvinyl pyrrolidone, a vinyl acetate copolymer, polyethylene oxide, sodium carboxymethyl cellulose, hydroxypropyl cellulose, methyl cellulose, ethyl cellulose, alginate, chitaric gum, gum arabic, gum tragacanth, karaya gum, carrageenan, methyl vinyl ether, a maleic anhydride copolymer, a polyoxyethylene alkyl ether such as polyoxyethylene ethyl ether and polyoxyethylene stearyl ether, a polyoxyethylene alkylphenol ether such as polyoxyethylene octylphenol ether and polyoxyethylene nonylphenol ether, and a water-soluble binder disclosed in Japanese Provisional Patent Publication No. 85535/1992, alone or in combination of two or more.

A processing method using a processing solution prepared by using the solid processing agent can be carried out by a known method.

In the following, the tetrazolium compound to be used in the present invention is described.

The tetrazolium compound can be represented by the following formula (T).

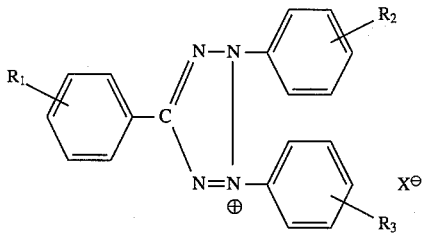

(T)

In the present invention, the substituents $R_1$, $R_2$ and $R_3$ of phenyl groups of the triphenyltetrazolium compound represented by the above formula (T) are preferably hydrogen atoms or those having negative or positive Hammett's sigma values (σP) indicating a degree of electron withdrawing ability. Particularly preferred is the group having a negative value.

The Hammett's sigma value in phenyl substitution can be found in the chemical literature, for example, a report by C. Hansch et al. in Journal of Medical Chemistry, vol. 20, p. 304, 1977. As a particularly preferred group having a negative sigma value, there may be mentioned, for example, methyl group (σP: −0.17 or less), ethyl group (σP: −0.15), cyclopropyl group (σP: −0.21), n-propyl group (σP: −0.13), isopropyl group (σP: −0.15), cyclobutyl group (σP: −0.15), n-butyl group (σP: −0.16), isobutyl group (σP: −0.20), n-pentyl group (σP: −0.15), cyclohexyl group (σP: −0.22), amino group (σP: −0.66), acetylamino group (σP: −0.15), hydroxyl group (σP: −0.37), methoxy group (σP: −0.27), ethoxy group (σP: −0.24), propoxy group (σP: −0.25), butoxy group (σP: −0.32 ) and pentoxy group (σP: −0.34 ). These groups are all useful as a substituent for the compound of the formula (IV) of the present invention.

As a specific example of the compound of the formula (T) used in the present invention, there may be mentioned, for example, IV-1 to IV-18 disclosed on page 8 to page 9 of Japanese Provisional Patent Publication No. 226143/1990, but the compound of the present invention is not limited to these. Specific examples thereof are shown below.

T-1

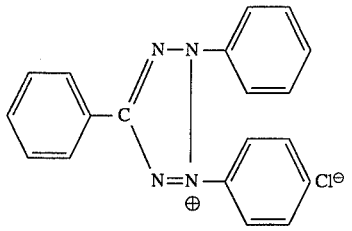

T-2

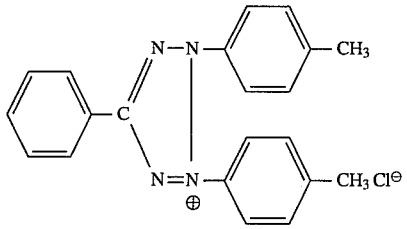

T-3

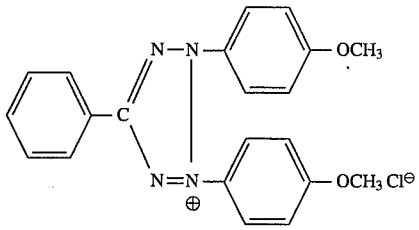

The hydrazine derivative to be used in the present invention preferably has a structure represented by the following formula (H).

$$A-\underset{A_1}{N}-\underset{A_2}{N}-G-R \qquad (H)$$

wherein A represents an aryl group or a heterocyclic group having at least one sulfur atom or oxygen atom; G represents $-(CO))_n-$ group, a sulfonyl group, a sulfoxy group, —P(O)(R)— group or an iminomethylene group; n represents an integer of 1 or 2; $A_1$ and $A_2$ both represent hydrogen atoms, or one represents hydrogen atom and the other represents a substituted or unsubstituted alkylsulfonyl group, or a substituted or unsubstituted acyl group; and R represents hydrogen atom, an alkyl group, an aryl group, an alkoxy group, an aryloxy group, amino group, a carbamoyl group, an oxycarbonyl group or $-O-R_4$ group where $R_4$ represents an alkyl group or a saturated heterocyclic group.

The structure is further preferably represented by the following formula (A), (B), (C) or (D).

$$A-NHNH-\overset{O}{\overset{\|}{C}}\Big)_n-N\begin{matrix}R^1\\R^2\end{matrix} \qquad (A)$$

-continued $$A-NHNH-\overset{O}{\overset{\|}{C}}-\overset{O}{\overset{\|}{C}}-O-R^3 \qquad (B)$$

wherein A represents an aryl group or a heterocyclic group having at least one sulfur atom or oxygen atom; n represents an integer of 1 or 2; when n is 1, $R^1$ and $R^2$ each represents hydrogen atom, an alkyl group, an alkenyl group, an alknyl group, an aryl group, a heterocyclic group, hydroxy group, an alkoxy group, an alkenyloxy group, an alkynyloxy group, an aryloxy group or a heterocyclic oxy group, and $R^1$ and $R^2$ may form a ring with mitrogen atom; when n is 2, $R^1$ and $R^2$ each represent hydrogen atom, an alkyl group, an alkenyl group, an alkynyl group, an aryl group, a saturated or unsaturated heterocyclic group, hydroxy group, an alkoxy group, an alkenyloxy group, an alkynyloxy group, an aryloxy group or a heterocyclic oxy group; when n is 2, either one of $R^1$ and $R^2$ represents an alkenyl group, an alkynyl group, a saturated heterocyclic group, an alkynyloxy group, an aryloxy group or a heterocyclic oxy group; and $R^3$ represents an alkynyl group or a saturated heterocyclic group.

The compound represented by the formula (A) or (B) includes those in which at least one H of —NHNH— in the formula is replaced by a substituent.

A, $R^1$ and $R^2$, more specifically, have the same meanings disclosed in Japanese Patent Application No. 222638/1990.

H of —NHNH— in the formulae (A) and (B), namely, hydrogen atom of hydrazine may be substituted by a substituent such as a sulfonyl group (e.g. methanesulfonyl and toluenesulfonyl), an acyl group (e.g. acetyl, trifluoroacetyl and ethoxycarbonyl) and an oxalyl group (e.g. ethoxalyl and pyruvoyl), and the compounds represented by the formulae (A) and (B) include those as described above.

The compound more preferred in the present invention is a compound of the formula (A) in which n is 2 and a compound of the formula (B).

In the compound of the formula (A) in which n is 2, more preferred is a compound in which $R^1$ and $R^2$ each represent hydrogen atom, an alkyl group, an alkenyl group, an alkynyl group, an aryl group, a saturated or unsaturated heterocyclic group, hydroxy group or an alkoxy group, and at least one of $R^1$ and $R^2$ represents an alkenyl group, an alkynyl group, a saturated heterocyclic group, hydroxy group or an alkoxy group.

Representative compounds represented by the above formulae (A) and (B) are Exemplary compounds (I-1) to (I-59) disclosed on page 3 to page 6 of Japanese Provisional Patent Publication No. 120852/1990, H-1 to H-130 disclosed on page 20 to page 44 of Japanese Patent Application No. 222638/1990, and those shown below. As a matter of course, specific compounds of the formulae (A) and (B) which can be used in the present invention are not limited to these compounds.

Specific exemplary compounds

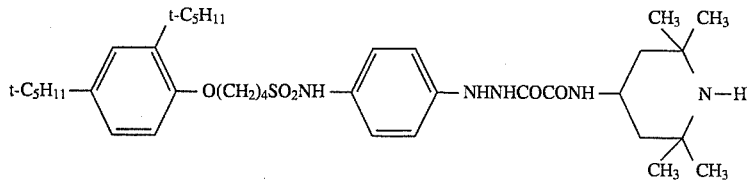

H-1

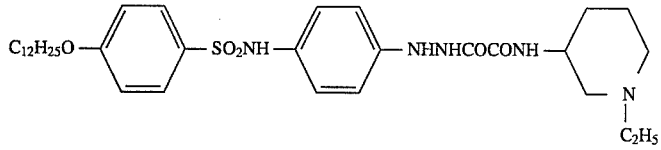

H-2

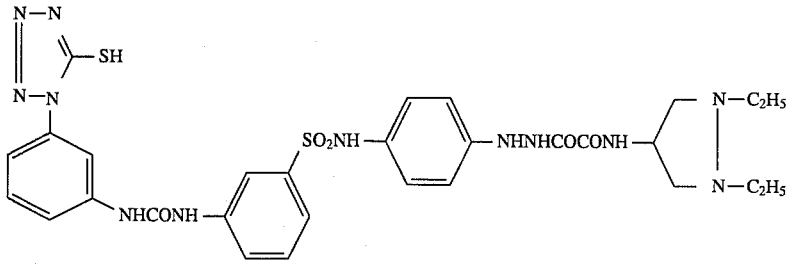

H-3

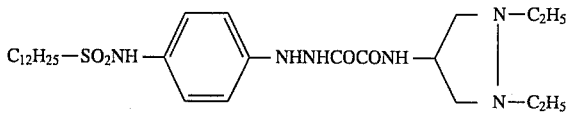

H-4

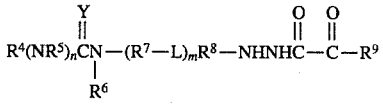

(C)

wherein $R^4$ and $R^5$ each represents hydrogen atom, a substituted or unsubstituted alkyl group (e.g. methyl group, ethyl group, butyl group, dodecyl group, 2-hydroxypropyl group, 2-cyanoethyl group and 2-chloroethyl group), a substituted or unsubstituted phenyl group, naphthyl group, cyclohexyl group, pyridyl group or pyrrolidyl group (e.g. phenyl group, p-methylphenyl group, naphthyl group, α-hydroxynaphthyl group, cyclohexyl group, p-methylcyclohexyl group, pyridyl group, 4-propyl-2-pyridyl group, pyrrolidyl group and 4-methyl- 2-pyrrolidyl group), $R^6$ represents hydrogen atom, a substituted or unsubstituted benzyl group, an alkoxy group or an alkyl group (e.g. benzyl group, p-methylbenzyl group, methoxy group, ethoxy group, ethyl group and butyl group), $R^7$ and $R^8$ each represents a divalent aromatic group (e.g. a phenylene group or a naphthylene group), Y represents sulfur atom or oxygen atom, L represents a divalent binding group (e.g. $—SO_2CH_2CH_2NH—$, $—SO_2NH—$, $—OCH_2SO_2NH—$, —O— and —CH=N—), $R^9$ represents —NR'R" or $—OR^{10}$ where R', R" and $R^{10}$ each represents hydrogen atom, a substituted or unsubstituted alkyl group, (e.g. methyl group, ethyl group and dodecyl group), phenyl group (e.g. phenyl group, p-methylphenyl group and p-methoxyphenyl group), naphthyl group (e.g. α-naphthyl group and β-naphthyl group) or a heterocyclic group (e.g. an unsaturated heterocyclic ring group such as pyridine, thiophen and furan, or a saturated heterocyclic ring group such as tetrahydrofuran and sulforane), and R' and R" may form a ring (e.g. piperidine, piperazine and morpholine) with nitrogen atom, and m and n each represents an integer of 0 or 1 When $R^9$ represents $—OR^{10}$, Y is preferably sulfur atom.

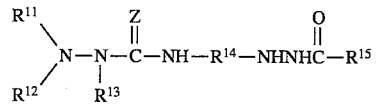

(D)

wherein $R^{11}$, $R^{12}$ and $R^{13}$ each represents hydrogen atom, an alkyl group (e.g. methyl group, ethyl group, butyl group and 2-aryloxypropyl group), a substituted or unsubstituted phenyl group, naphthyl group, cyclohexyl group, pyridyl group, pyrrolidyl group, a substituted or unsubstituted alkoxy group (e.g. methoxy group, ethoxy group and butoxy group) or substituted or unsubstituted aryloxy group (e.g. phenoxy group and 4-methylphenoxy group), $R^{13}$ is preferably hydrogen atom or an alkyl group, $R^{14}$ represents a divalent aromatic group (e.g. phenylene group and naphthylene group), Z represents sulfur atom or oxygen atom, $R^{15}$ represents a substituted or unsubstituted alkyl group, alkoxy group or amino group, and as the substitutent, there may be mentioned an alkoxy group, cyano group and aryl group.

The above hydrazine derivative can be easily synthesized by a known method, but for example, they can be synthesized in accordance with the methods described in Japanese Provisional Patent Publications No. 214850/1990, No. 47646/1990 and No. 12237/1990.

Specific examples of the above formulae (C) and (D) are shown below.

H-5

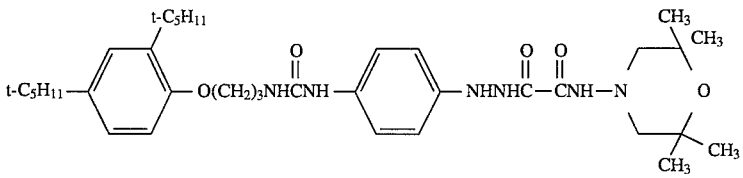

H-6

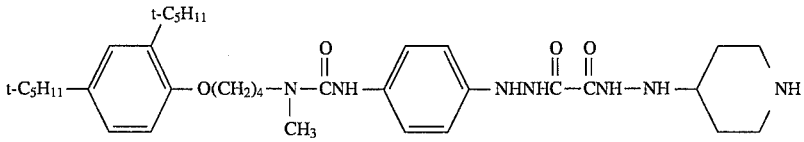

H-7

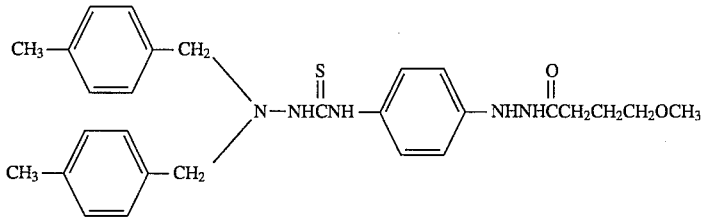

The silver halide to be used in the light-sensitive silver halide photographic material according to the present invention is preferably silver chloride, silver chlorobromide and silver chloroiodobromide having any desired composition, and contains at least 50 mole % of silver chloride. The average grain size of a silver halide grain is preferably in the range of 0.025 to 0.5 μm, more preferably 0.05 to 0.30 μm.

The silver halide grain according to the present invention is so prepared that it has a monodispersed degree of preferably 5 to 60, more preferably 8 to 30. The grain size of the silver halide grain according to the present invention is represented by an edge length of a cubic grain for convenience, and the monodispersed degree is represented by a numerical value obtained by dividing a standard deviation of the grain size by the average grain size and increasing the divided value by hundred times.

As the silver halide which can be used in the present invention, there may be preferably used a silver halide having a multilayer structure in which at least two layers are laminated. It may be, for example, a silver chlorobromide grain in which a core portion is silver chloride and a shell portion is silver bromide, or a core portion is silver bromide and a shell portion is silver chloride. In that case, 5% mole or less of iodine may be contained in any desired layer.

Further, a mixture of at least two kinds of grains may be used. For example, there may be used a grain mixture in which a primary grain is a cubic, octahedral or flat silver chloroiodobromide grain containing 10 mole % or less of silver chloride and 5 mole % or less of iodine, and a secondary grain is a cubic, octahedral or flat silver chloroiodobromide grain containing 15 mole % or less of iodine and 50 mole % or more of silver chloride. When such a grain mixture is used, the primary and secondary grains may be chemically sensitized as desired, but chemical sensitization (sulfur sensitization and gold sensitization) may be so suppressed that the sensitivity of the secondary grain becomes lower than that of the primary grain, or a grain size or an amount of noble metal such as rhodium doped on the grain size and the inner portion may be so controlled that the sensitivity of the secondary grain is lowered. Further, the inner portion of the secondary grain may be fogged with gold, or may be fogged by changing compositions of a core and a shell by the core/shell method. The primary grain and the secondary grain are preferably made as small as possible, and they may have any desired size between 0.025 μm and 1.0 μm.

When the silver halide emulsion to be used in the present invention is prepared, sensitivity and tone can be controlled by adding a rhodium salt. The rhodium salt is generally added preferably at the time of forming the grain, but may be added at the time of chemical ripening or at the time of preparing an emulsion coating solution.

The rhodium salt added to the silver halide emulsion used in the present invention may be either a simple salt or a double salt. As a representative example, there may be used rhodium chloride, rhodium trichloride and rhodium ammonium chloride.

The amount of the rhodium salt to be added varies without restraint depending on the required sensitivity and tone, but the range of $10^{-9}$ mole to $10^{-4}$ mole per mole of silver is particularly useful.

When the rhodium salt is used, other inorganic compounds, for example, an iridium salt, a platinum salt, a thallium salt, a cobalt salt and a gold salt may be used in combination. An iridium salt is frequently preferably used in an amount of $10^{-9}$ mole to $10^{-4}$ mole per mole of silver for the purpose of improving high illuminance characteristics.

The silver halide to be used in the present invention can be sensitized by various chemical sensitizers. As the sensitizer, there may be used, for example, active gelatin, a sulfur sensitizer (sodium thiosulfate, allylthiocarbamide, thiourea and allylisothiocyanate), a selenium sensitizer (N,N-dimethylselenourea and selenourea), a reducing sensitizer (triethylenetetramine and stannous chloride), and various noble metal sensitizers represented by, for example, potassium chloroaurite, potassium aurothiocyanate, potassium chloroaurate, 2-aurosulfobenzothiazole methyl chloride, ammonium chloropalladate, potassium chloroplatinate and sodium chloropalladite, alone or in combination of two or more. When a gold sensitizer is used, ammonium thiocyanate may be used as an aid.

In the silver halide emulsion to be used in the present invention, there may be used desensitizing dyes and/or UV absorbers disclosed in, for example, U.S. Pat. Nos. 3,567,458, 3,615,639, 3,579,345, 3,615,608, 3,598,596, 3,598,955, 3,592,653 and 3,582,343, and Japanese Patent Publications No. 26751/1965, No. 27332/1965, No. 13167/1968, No. 8833/1970 and No. 8746/1972.

The silver halide emulsion to be used in the present invention can be stabilized by using, for example, compounds disclosed in U.S. Pat. Nos. 2,444,607, 2,716,062 and 3,512,982, German Patent Publications No. 11 89 380, No. 20 58 626 and No. 21 18 411, Japanese Patent Publication No. 4133/1968, U.S. Pat. No. 3,342,596, Japanese Patent Publication No. 4417/1972, German Patent Publication NO. 21 49 789, and Japanese Patent Publications No. 2825/1964 and No. 13566/1964, preferably, for example, 5, 6-trimethylene- 7-hydroxy-s-triazolo (1,5-a) pyrimidine, 5, 6-tetramethylene- 7-hydroxy-s-triazolo (1, 5-a) pyrimidine, 5-methyl- 7-hydroxy-s-triazolo (1,5-a) pyrimidine, 5-methyl-7-hydroxy-s-triazolo( 1, 5-a) pyrimidine, 7-hydroxy-s-triazolone (1,5-a) pyrimidine, 5-methyl-6-bromo-7-hydroxy-s-triazolo(1,5-a)pyrimidine, a gallate (e.g. isoamyl gallate, dodecyl gallate, propyl gallate and sodium gallate), mercaptans (1-phenyl-5-mercaptotetrazole and 2-mercaptobenzthiazole), benzotriazoles (5-bromobenzotriazole and 5-methylbenzotriazole) and benzoimidazoles (6-nitrobenzoimidazole).

In the light-sensitive silver halide photographic material and/or the developing solution according to the present invention, an amino compound is preferably contained.

The amino compound preferably used in the present invention includes all primary to quaternary amines. As an example of the preferred amino compound, alkanolamines may be mentioned. In the following, preferred specific examples are listed, but the amino compound is not limited to these compounds.

Diethylaminoethanol
Diethylaminobutanol
Diethylaminopropane-1,2-diol
Diethylaminopropane-1,2-diol
Diethanolamine
Diethylamino-1-propanol
Triethanolamine
Dipropylaminopropane-1,2-diol
Dioctylamino-1-ethanol
Dioctylaminopropane-1,2-diol
Dodecylaminopropane-1,2-diol
Dodecylamino- 1 -propanol
Dodecylamino- 1 -ethanol
Aminopropane-1,2-diol
Diethylamino-2 -propanol
Dipropanolamine
Glycine
Triethylamine
Triethylenediamine The amino compound may be contained in at least one coating layer (e.g. a silver halide emulsion layer, a protective layer and a hydrophilic colloid layer of a subbing layer) at a light-sensitive layer side of the light-sensitive silver halide photographic material, and/or the developing solution, and may be preferably contained in the developing solution. The amount of the amino compound to be contained varies depending on the layer or solution in which it is contained and the kind of the amino compound, but an amount for promoting contrast is required.

For enhancing developability, a developing agent such as phenidone or hydroquinone, and an inhibitor such as benzotriazole may be contained in the emulsion side. For increasing processability of the processing solution, the developing agent and inhibitor may be contained in a backing layer.

The hydrophilic colloid particularly advantageously used in the present invention is gelatin. As a hydrophilic colloid other than gelatin, there may be mentioned, for example, colloidal albumin, agar, gum arabic, alginic acid, hydrolyzed cellulose acetate, acrylamide, imidated polyamide, polyvinyl alcohol, hydrolyzed polyvinyl acetate, a gelatin derivative such as phenylcarbamyl gelatin, acylated gelatin, phthalated gelatin as disclosed in U.S. Pat. Nos. 2,614,928 and 2,525,753, or a graft polymer of gelatin with a polymerizable monomer having an ethylene group such as styrene acrylate, acrylate, methacrylic acid and methacrylate as disclosed in U.S. Pat. Nos. 2,548,520 and 2,831,767, and these hydrophilic colloids may be used suitably in a layer containing no silver halide, for example, an antihalation layer, a protective layer and an intermediate layer.

As a support to be used in the present invention, there may be included representatively a baryta paper, a polyethylene-coated paper, a polypropylene synthetic paper, a glass plate, cellulose acetate, cellulose nitrate, a polyester film such as polyethylene terephthalate, a polyamide film, a polypropylene film, a polycarbonate film and a polystyrene film. These supports are selected suitably depending on the respective purposes of use of the light-sensitive silver halide photographic material.

EXAMPLES

In the following, Examples of the present invention are shown more specifically, but it is needless to say that the present invention is not limited by these Examples.

Example 1

(Synthesis of latex Lx)

To a solution in which 0.125 kg of gelatin and 0.05 kg of ammonium persulfate were added to 40 liter of water was added, at a solution temperature of 80° C. under stirring and nitrogen atmosphere, a mixed solution of (a) 4.51 kg of n-butyl acrylate, (b) 5.49 kg of styrene and (c) 0.1 kg of acrylic acid over one hour, and the mixture was further stirred for 1.5 hours. Then, to the mixture were added 1.25 kg of gelatin and 0.005 kg of ammonium persulfate and the mixture was stirred for 1.5 hours. After completion of the reaction, the reaction mixture was subjected to vapor evaporation for one hour to remove a residual monomer. After cooling to room temperature, the pH of the reaction mixture was adjusted to 6.0 by using ammonia. The resulting latex solution was finished to 50.5 kg with addition of water.

According to the above procedure, a monodispersed latex having an average particle size of 0.25 μm and Tg of about 0° C. was obtained.

(Preparation of emulsion A)

A silver sulfate solution and a solution in which $8\times10^{-5}$ mol/Ag mol of rhodium hexachloride complex is added to an aqueous solution of sodium chloride and potassium bromide were simultaneously added to a gelatin solution while controlling flow amounts, and after desalting, a cubic, monodispersed silver chlorobromide emulsion having a diameter of 0.13 μm and containing 1 mole % of silver bromide was obtained.

This emulsion was sulfur sensitized by a conventional method, and after adding 6-methyl-4-hydroxy-1,3,3a, 7-tetrazaindene, the following additives were added to prepare emulsion coating solutions E-1 to E-14, respectively. Subsequently, an emulsion protective layer coating solution P-O, a backing layer coating solution B-O and a backing protective layer coating solution BP-O were prepared according to the following compositions, respectively.

| (Preparation of emulsion coating solutions E-1 to E-14) | |
|---|---|
| Compound (a) | 1 mg/m$^2$ |
| NaOH (0.5 N) | adjusted to pH 5.6 |
| Compound (b) | 40 mg/m$^2$ |
| Compound (c) | 30 mg/m$^2$ |
| Saponin (20%) | 0.5 cc/m$^2$ |
| Sodium dodecylbenzenesulfonate | 20 mg/m$^2$ |
| 5-Methylbenzotriazole | 10 mg/m$^2$ |
| Compound (d) | 2 mg/m$^2$ |
| Compound (e) | 10 mg/m$^2$ |
| Compound (f) | 6 mg/m$^2$ |
| Latex Lx | amount shown in Table 1 |
| Styrene-maleic acid copolymerized polymer (thickening agent) | 90 mg/m$^2$ |

Compound (a)

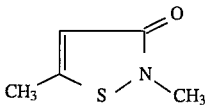

Compound (b) Tetrazolium compound T-3

Compound (c)

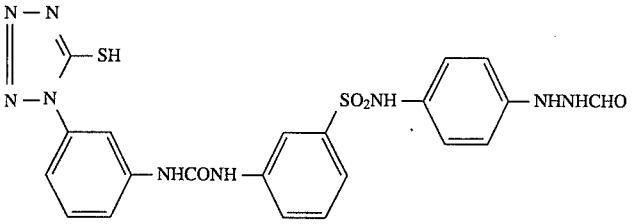

Compound (d)

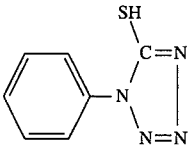

Compound (e)

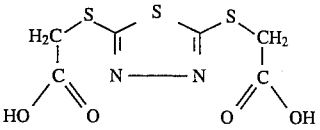

Compound (f)

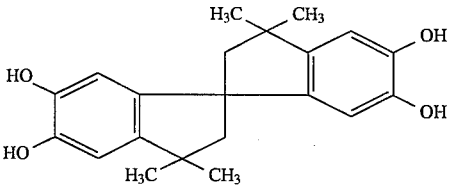

| (Emulsion protective layer coating solution P-0) | |
|---|---|
| Gelatin | 0.5 g/m$^2$ |
| Compound (g) (1%) | 25 cc/m$^2$ |
| Compound (h) | 120 mg/m$^2$ |
| Spherical monodispersed silica (8 μm) | 20 mg/m$^2$ |
| Spherical monodispersed silica (3 μm) | 10 mg/m$^2$ |
| Compound (i) | 100 mg/m$^2$ |
| Citric acid | adjusted to pH 6.0 |

-continued

| (Backing layer coating solution B-0) | |
|---|---|
| Gelatin | 1.0 g/m$^2$ |
| Compound (i) | 100 mg/m$^2$ |
| Compound (k) | 18 mg/m$^2$ |
| Compound (l) | 100 mg/m$^2$ |
| Saponin (20%) | 0.8 cc/m$^2$ |
| Latex (m) | 300 mg/m$^2$ |
| 5-Nitroindazole | 20 mg/m$^2$ |

-continued

| | |
|---|---|
| Styrene-maleic acid copolymerized polymer (thickening agent) | 45 mg/m$^2$ |
| Glyoxal | 4 mg/m$^2$ |
| Compound (o) | 150 mg/m$^2$ |
| (Backing protective layer coating solution BP-0) | |
| Gelatin | 0.5 g/m$^2$ |
| Compound (g) (1%) | 2 cc/m$^2$ |
| Spherical monodispersed silica (4 μm) | 25 mg/m$^2$ |
| Sodium chloride | 70 mg/m$^2$ |
| Glyoxal | 22 mg/m$^2$ |
| Compound (n) | 10 mg/m$^2$ |

Compound (g)

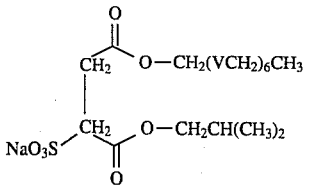

Compound (h)

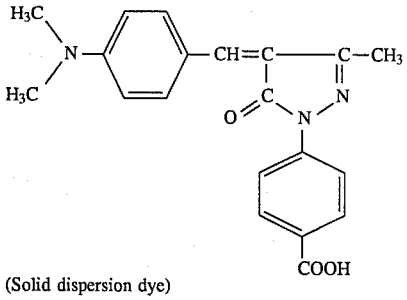

(Solid dispersion dye)

Compound (i)

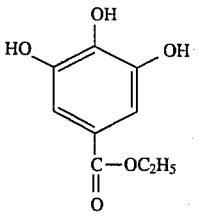

Compound (j)

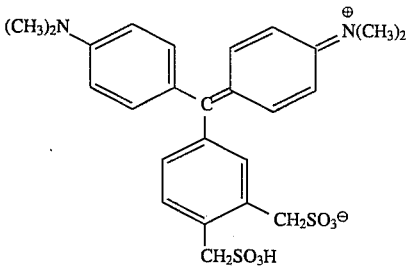

Compound (k)

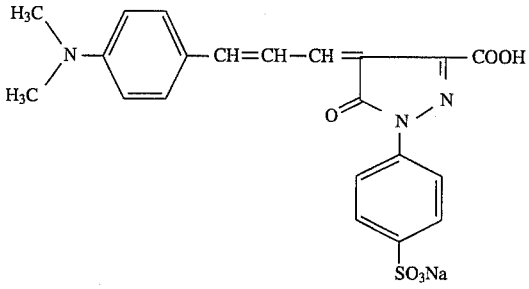

Compound (l)

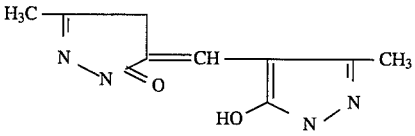

Compound (m)

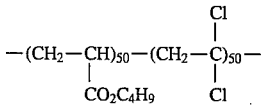

Compound (n)

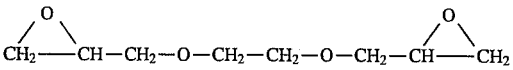

Compound (o)

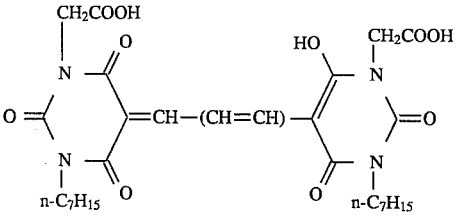

Each coating solution thus prepared as mentioned above was coated, after corona discharging with 10 W/(m$^2$.min) on a polyethyleneterephthalate base subjected to subbing treatment as mentioned in Japanese Provisional Patent Publication No. 19941/1984 and having a thickness of 10 μm by using a roll fit coating pan and air knife with the composition as mentioned below. Drying was carried out at 90° C. and parallel current drying conditions with an overall coefficient of heat transfer of 25 kcal (m$^2$.hr.°C.) for 30 seconds and then at 140° C. for 90 seconds. A film thickness of the layer after drying was 1 μm and a surface specific resistance of the layer was $1\times10^8$ Ω at 23° C. and 55% relative humidity (RH).

Water-soluble polymer 70 g/l

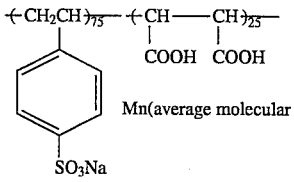

Mn(average molecular Wt.) = 5000

-continued

Hydrophobic polymer particle 40 g/l

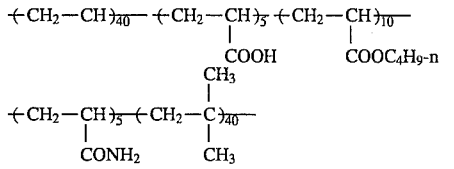

Ammonium sulfate 0.5 g/l
Polyethylene oxide compound
(Average molecular weight Mn: 600) 6 g/l
Hardening agent 12 g/l
which is a mixture of

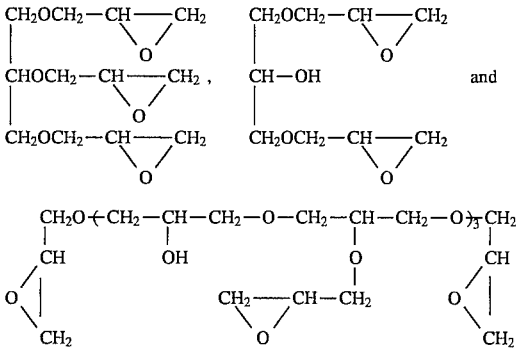

On the base were subjected to simultaneous multilayer coating, as an emulsion surface side, an emulsion layer and an emulsion protective layer in this order from the side near to a support by a slide hopper system while adding a hardening agent solution thereto, and the coated material was passed through a cold air setting zone (5° C.). Then, a backing layer and a backing protective layer were also coated by the slide hopper while adding a hardening agent solution thereto and the coated material was cold air set (5° C.). When the material passed each of the setting zone, the coated solution showed sufficient setting property. Subsequently, both surfaces were simultaneously dried in a drying zone under the following drying conditions. After coating with the backing solution with both surfaces, the material was transferred by a roller until winding up and others by no contact state. A coating rate at this time was 100 m/min.

(Drying conditions)

After setting, the material was dried with a drying air of 30° C. until $H_2O$/gelatin weight ratio became 800%, and it was dried with a drying air of 35° C. (30% RH) during 800 to 200%. While blowing air, after 30 seconds from the surface temperature became 34° C. (which was deemed to be completion of drying), the material was dried with air of 48° C. and 16% RH for one minute. At this time, a drying time was 50 seconds from initiation of drying to $H_2O$/gelatin ratio of 800%, 35 seconds during 800% to 200% and 5 seconds during 200% to completion of drying.

This light-sensitive material was wound up at 23° C. and 15 % RH, and then cut under the same conditions and sealed in a barrier bag which had been rehumidified under the same conditions for 3 hours with a card board (which had been rehumidified at 40° C. and 10% RH for 8 hours and then rehumidified at 23° C. and 15% RH for 2 hours).

(Preparation method of developing solution)

After preparing a developing solution (d/) having the composition shown below, it was concentrated to water content/hydroquinone=2500% under reduced pressure and vacuum freezed by spreading into vacuum through holes with 1 mmϕ (1 mm diameter).

The formed string-like solid product was cut to a length of about 2 cm and dried at 35° C. and 0.5 Torr for 12 hours to obtain a developing solid composition (ds).

Water content/hydroquinone (d/) 2500%, (ds) 0.03%

The developing solution and solid composition (d/) and (ds) were sealed in a plastic vessel made of a polyester and coated by a polyethylene, and stored under the conditions as shown below.

| (Storing condition) | | |
|---|---|---|
| Condition (1) | 5° C. | 7 days |
| Condition (2) | 23° C. | 7 days |
| Condition (3) | 40° C. | 7 days |

The developing solution and solid composition (d/) and (ds) were each made up to 1000 ml to prepare developing solutions (D/) and (Ds). These developing solutions were also stored under the same conditions (1) to (3) mentioned above.

| (Developing solution recipe) | |
|---|---|
| Pure water (deionized water) | 150 ml |
| Disodium ethylenediaminetetraacetate | 27 g |
| Polyethylene glycol (Mn: 600) | 5 g |
| Potassium sulfite (55% W/V aqueous solution) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide | an amount which made a pH of the solution at use 10.9 |
| Acetic acid (90% aqueous solution) | 0.3 ml |
| 5-Nitroindazole | 110 mg |
| 1-Phenyl-3-pyrazolidone | 500 mg |
| (Fixing solution recipe) | |
| Ammonium thiosulfate (72.5% W/V aqueous solution) | 230 ml |
| Sodium sulfite | 9.5 g |
| Sodium acetate.trihydrate | 15.9 g |
| Boric acid | 6.7 g |
| Sodium citrate.dihydrate | 2 g |
| Acetic acid (90% W/V aqueous solution) | 8.1 ml |
| Pure water (deionized water) | 17 ml |
| Sulfuric acid (50% W/V aqueous solution) | 5.8 g |
| Aluminum sulfate (an aqueous solution wherein the content of $Al_2O_3$ is 8.1% W/V) | 26.5 g |

When using the fixing solution, the above components were dissolved in 500 ml of water in this order and used by making up to one liter. A pH of the fixing solution was about 4.3.

The black-and-white light sensitive photographic material was subjected to wedge exposure by using UV ray and processed with an automatic processor GR-27 (trade name, manufactured by KONICA CORPORATION) under developing conditions of 28° C. for 30 seconds using the above processing solution, and a sensitivity was determined by an inverse number of an exposed dose which provides a concentration of 2.5.

Also, pinholes at blackened portion and sharpness after running processing were evaluated by the following method. Evaluation of pinholes was carried out by observing the surface with eyes using a 100-fold magnifying glass. The rank "5" is the best having no pinhole, the rank "1" is the worst and the rank "3" or more can be practically used.

Evaluation of sharpness after running processing was shown by a gamma (γ) value (tangent at direct portion) when 700 sheets of each film sample (25 cm×30 cm, blackening degree: 50%) were processed by using the above automatic processor GR-27 (trade name, manufactured by KONICA CORPORATION). These results are shown in Table 1.

TABLE 1

| | Stored conditions | | | | | |
|---|---|---|---|---|---|---|
| | Before preparation | After preparation | Relative sensitivity | Pinhole | Sharpness after running | Remarks |
| Granule | (1) | (1) | 1.68 | 5 | 11.9 | This invention |
| | " | (2) | 1.65 | 5 | 11.9 | This invention |
| | " | (3) | 1.63 | 4.5 | 11.8 | This invention |
| | (2) | (1) | 1.68 | 5 | 11.9 | This invention |
| | " | (2) | 1.65 | 5 | 11.9 | This invention |
| | " | (3) | 1.63 | 4.5 | 11.8 | This invention |
| | (3) | (1) | 1.66 | 5 | 11.9 | This invention |
| | " | (2) | 1.63 | 4.5 | 11.9 | This invention |
| | " | (3) | 1.61 | 4.5 | 11.8 | This invention |
| Tablet | (1) | (1) | 1.68 | 5 | 11.9 | This invention |
| | " | (2) | 1.64 | 5 | 11.9 | This invention |
| | " | (3) | 1.63 | 4.5 | 11.9 | This invention |
| | (2) | (1) | 1.68 | 5 | 11.9 | This invention |
| | " | (2) | 1.65 | 5 | 11.9 | This invention |
| | " | (3) | 1.63 | 4.5 | 11.8 | This invention |
| | (3) | (1) | 1.66 | 5 | 11.9 | This invention |
| | " | (2) | 1.64 | 4.5 | 11.9 | This invention |
| | " | (3) | 1.62 | 4.5 | 11.8 | This invention |
| Ds | (1) | (1) | 1.67 | 5 | 11.9 | This invention |
| | " | (2) | 1.64 | 5 | 11.9 | This invention |
| | " | (3) | 1.62 | 4.5 | 11.8 | This invention |
| | (2) | (1) | 1.67 | 5 | 11.9 | This invention |
| | " | (2) | 1.65 | 4.75 | 11.8 | This invention |
| | " | (3) | 1.63 | 4.5 | 11.8 | This invention |
| | (3) | (1) | 1.66 | 5 | 11.9 | This invention |
| | " | (2) | 1.63 | 4.5 | 11.8 | This invention |
| | " | (3) | 1.61 | 4.5 | 11.8 | This invention |
| Dl | (1) | (1) | 1.68 | 3.5 | 10.4 | Comparative |
| | " | (2) | 1.61 | 3.0 | 10.0 | Comparative |
| | " | (3) | 1.49 | 2.5 | 9.3 | Comparative |
| | (2) | (1) | 1.62 | 3.25 | 10.2 | Comparative |
| | " | (2) | 1.55 | 2.75 | 9.6 | Comparative |
| | " | (3) | 1.35 | 2.5 | 9.2 | Comparative |
| | (3) | (1) | 1.51 | 3.0 | 9.7 | Comparative |
| | " | (2) | 1.25 | 2.75 | 9.5 | Comparative |
| | " | (3) | 1.07 | 2.25 | 8.9 | Comparative |

As a granule, those having a grain size of 1.5 mm were prepared by an extrusion granulator and as a tablet, those having a grain size of 1 cm were prepared by a compression granulator. As a binder, water was used for both of the granule and tablet.

As can be seen from the results in Table 1, it can be understood that Ds is extremely low in activity decrease after storing as compared to Dl.

Example 2

In the same manner as in Example 1 except that the preparation method of a light-sensitive material in Example 1 was changed as shown below and a tungsten light was used for exposure, the same evaluation was carried out. The results are shown in Table 3.

(Preparation of emulsion B) By using solution A, solution B and solution C shown below, a silver chlorobromide emulsion was prepared.

| | |
|---|---|
| <Solution A> | |
| Ossein gelatin | 17 g |
| Sodium polyisopropylene-polyethylene-oxydisuccinate (10% ethanol solution) | 5 ml |
| Distilled water | 1280 ml |
| <Solution B> | |
| Silver nitrate | 170 g |
| Distilled water | 410 ml |
| <Solution C> | |
| Sodium hydroxide | 45.0 g |
| Potassium bromide | 27.4 g |
| Rhodium trichloride trihydrate | 28 μg |
| Sodium polyisopropylene-polyethylene-oxydisuccinate (10% ethanol solution) | 3 ml |
| Ossein gelatin | 11 g |
| Distilled water | 470 ml |

After Solution A was maintained at 40° C., sodium chloride was added thereto so as to become EAg value of 160 mV. Next, by using a mixing stirrer disclosed in Japanese Provisional Patent Publication No. 92523/1982 or No. 92524/1982, Solution B and Solution C were added thereto by the double jet method.

Added flow amounts were gradually increased over total addition time of 80 minutes as shown in Table 2 while maintaining the $E_{Ag}$ value constant.

The $E_{Ag}$ value was changed from 160 mV to 120 mV after 5 minutes from initiation of the addition by using 3 mole/liter of a sodium chloride solution, and the value was maintained until completion of the mixing.

In order to maintain the $E_{Ag}$ value constant, the EAg value was controlled by using 3 mole/liter of a sodium chloride solution.

TABLE 2

| Addition time (min) | Solution B (ml/min) | Solution B (ml/min) |
|---|---|---|
| 0 | 1.13 | 1.11 |
| 10 | 1.13 | 1.11 |
| 20 | 2.03 | 1.99 |
| 30 | 3.17 | 3.11 |
| 40 | 4.57 | 4.48 |
| 50 | 6.22 | 6.10 |
| 60 | 8.13 | 7.97 |
| 70 | 10.29 | 10.01 |
| 80 | 12.74 | 12.49 |

For measurement of the $E_{Ag}$ value, a metal silver electrode and a double junction type saturated Ag/AgCl reference electrode were used (a double junction disclosed in Japanese Provisional Patent Publication No. 197534/1982 was sued as a constitution of an electrode).

Also, for addition of Solution B and Solution C, a flow amount variable roller tube quantitative pump was used.

During addition, by sampling an emulsion, it was confirmed that occurrence of new grains in the system had not been admitted by observation using an electron microscope.

During addition, a pH value of the system was controlled by a 3 % nitric acid aqueous solution so as to maintain the value of 3.0.

After completion of the addition of Solution B and Solution C, the emulsion was subjected to Ostwald ripening, and then subjected to desalting and washing. Then, 600 ml of an aqueous solution of ossein gelatin (containing 30 g of ossein gelatin) was added thereto and dispersed by stirring at 55° C. for 30 minutes, and then the mixture was adjusted to 750 ml.

To the emulsion (B) thus obtained was applied gold-sulfur sensitization, i.e. by adding the following sensitizing dye A in an amount of 300 mg per mole of silver halide contained in the emulsion and also adding 4-hydroxy-6-methyl- 1,3, 3a,7-tetrazaindene as a stabilizer, and further adding 100 mg of the following sensitizing dye B per mole of the silver halide to prepare an emulsion B.

Then, 700 mg of the following tetrazolium compound T was added per mole of silver halide, and 300 mg of sodium p-dodecylbenzenesulfonate, 2 g of a styrene-maleic acid copolymer and 15 g of a styrene-butyl acrylate-acrylic acid copolymer latex (average particle size: about 0.25 μm) were further added. This material was coated on a polyethylene-terephthalate film base which had been subjected to subbing treatment described in Japanese Provisional Patent Publication No. 19941/1984, Example (1), so as to become an Ag amount of 4.0 g/m$^2$ and a gelatin amount of 2.0 g/m$^2$. At this time, a protective layer containing 10 mg/m$^2$ of bis-( 2-ethylhexyl)sulfosuccinate as a spreading agent and 25 mg/m$^2$ of formalin as a hardening agent was simultaneously multilayer coated so as to become a gelatin amount of 1.0 g/m$^2$.

Sensitizing dye A

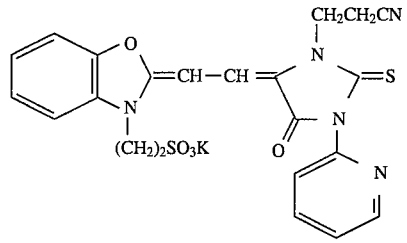

Sensitizing dye B

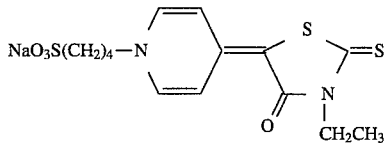

Tetrazolium compound T

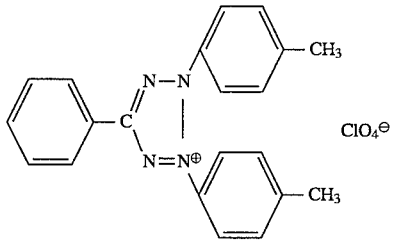

TABLE 3

| | Stored conditions | | | | Sharp- | |
|---|---|---|---|---|---|---|
| | Before prepa-ration | After prepa-ration | Relative sensi-tivity | Pin-hole | ness after running | Remarks |
| Granule | (1) | (1) | 1.37 | 4.5 | 11.5 | This in-vention |
| | " | (2) | 1.37 | 4.5 | 11.5 | This in-vention |
| | " | (3) | 1.35 | 4.5 | 11.4 | This in-vention |
| | (2) | (1) | 1.36 | 4.5 | 11.5 | This in-vention |
| | " | (2) | 1.37 | 4.5 | 11.5 | This in-vention |
| | " | (3) | 1.35 | 4.5 | 11.4 | This in-vention |
| | (3) | (1) | 1.35 | 4.5 | 11.4 | This in-vention |
| | " | (2) | 1.35 | 4.5 | 11.4 | This in-vention |
| | " | (3) | 1.35 | 4.5 | 11.4 | This in-vention |
| Tablet | (1) | (1) | 1.37 | 4.5 | 11.5 | This in-vention |
| | " | (2) | 1.36 | 4.5 | 11.5 | This in-vention |
| | " | (3) | 1.35 | 4.5 | 11.4 | This in-vention |
| | (2) | (1) | 1.36 | 4.5 | 11.5 | This in-vention |
| | " | (2) | 1.37 | 4.5 | 11.5 | This in-vention |
| | " | (3) | 1.35 | 4.5 | 11.4 | This in-vention |

TABLE 3-continued

| | Stored conditions | | | | | |
|---|---|---|---|---|---|---|
| | Before preparation | After preparation | Relative sensitivity | Pinhole | Sharpness after running | Remarks |
| | (3) | (1) | 1.35 | 4.5 | 11.4 | This invention |
| | " | (2) | 1.35 | 4.5 | 11.4 | This invention |
| | " | (3) | 1.35 | 4.5 | 11.4 | This invention |
| Ds | (1) | (1) | 1.37 | 4.5 | 11.5 | This invention |
| | " | (2) | 1.36 | 4.5 | 11.4 | This invention |
| | " | (3) | 1.35 | 4.5 | 11.4 | This invention |
| | (2) | (1) | 1.36 | 4.5 | 11.5 | This invention |
| | " | (2) | 1.37 | 4.5 | 11.4 | This invention |
| | " | (3) | 1.35 | 4.5 | 11.4 | This invention |
| | (3) | (1) | 1.35 | 4.5 | 11.4 | This invention |
| | " | (2) | 1.35 | 4.5 | 11.4 | This invention |
| | " | (3) | 1.34 | 4.5 | 11.4 | This invention |
| Dl | (1) | (1) | 1.35 | 3 | 10.2 | Comparative |
| | " | (2) | 1.31 | 2.75 | 9.5 | Comparative |
| | " | (3) | 1.22 | 2.25 | 9.1 | Comparative |
| | (2) | (1) | 1.33 | 3 | 10.1 | Comparative |
| | " | (2) | 1.28 | 2.75 | 9.4 | Comparative |
| | " | (3) | 1.15 | 2.0 | 9.2 | Comparative |
| | (3) | (1) | 1.30 | 2.75 | 10.0 | Comparative |
| | " | (2) | 1.17 | 2.0 | 9.4 | Comparative |
| | " | (3) | 0.95 | 1.75 | 8.9 | Comparative |

When the emulsion B was used, substantially the same results as in Example 1 can be obtained.

Example 3

In the same manner as in Example 1 except for changing the water content/hydroquinone of the developing solution to those as shown in Table 4, the same experiments were carried out. The results are shown in Table 4.

TABLE 4

| | Stored condition | | | | | |
|---|---|---|---|---|---|---|
| | Before preparation | After preparation | Relative sensitivity | Pinhole | Sharpness after running | Remarks |
| Granular state (40%) | (1) | (1) | 1.68 | 5 | 11.9 | This invention |
| | " | (2) | 1.65 | 5 | 11.9 | This invention |
| | " | (3) | 1.63 | 4.5 | 11.8 | This invention |
| | (3) | (1) | 1.67 | 5 | 11.9 | This invention |

TABLE 4-continued

| | Stored condition | | | | | |
|---|---|---|---|---|---|---|
| | Before preparation | After preparation | Relative sensitivity | Pinhole | Sharpness after running | Remarks |
| | " | (2) | 1.64 | 4.5 | 11.9 | This invention |
| | " | (3) | 1.62 | 4.5 | 11.8 | This invention |
| Tablet state (20%) | (1) | (1) | 1.68 | 5 | 11.9 | This invention |
| | " | (2) | 1.64 | 5 | 11.9 | This invention |
| | " | (3) | 1.63 | 4.5 | 11.9 | This invention |
| | (3) | (1) | 1.67 | 5 | 11.9 | This invention |
| | " | (2) | 1.65 | 4.5 | 11.9 | This invention |
| | " | (3) | 1.63 | 4.5 | 11.8 | This invention |
| Paste state (200%) | (1) | (1) | 1.68 | 5 | 11.9 | This invention |
| | " | (2) | 1.65 | 5 | 11.9 | This invention |
| | " | (3) | 1.62 | 4.5 | 11.8 | This invention |
| | (3) | (1) | 1.67 | 5 | 11.9 | This invention |
| | " | (2) | 1.66 | 4.5 | 11.9 | This invention |
| | " | (3) | 1.63 | 4.5 | 11.8 | This invention |
| Paste state (300%) | (1) | (1) | 1.68 | 5 | 11.9 | This invention |
| | " | (2) | 1.65 | 5 | 11.9 | This invention |
| | " | (3) | 1.63 | 4.5 | 11.8 | This invention |
| | (3) | (1) | 1.67 | 5 | 11.9 | This invention |
| | " | (2) | 1.65 | 4.5 | 11.8 | This invention |
| | " | (3) | 1.63 | 4.5 | 11.8 | This invention |
| Paste state (400%) | (1) | (1) | 1.68 | 5 | 11.9 | This invention |
| | " | (2) | 1.64 | 5 | 11.9 | This invention |
| | " | (3) | 1.61 | 4.5 | 11.8 | This invention |
| | (3) | (1) | 1.65 | 5 | 11.9 | This invention |
| | " | (2) | 1.63 | 4.5 | 11.8 | This invention |
| | " | (3) | 1.62 | 4.5 | 11.8 | This invention |
| Paste state (500%) | (1) | (1) | 1.68 | 5 | 11.9 | This invention |
| | " | (2) | 1.63 | 5 | 11.9 | This invention |
| | " | (3) | 1.62 | 4.5 | 11.8 | This invention |
| | (3) | (1) | 1.65 | 5 | 11.9 | This invention |
| | " | (2) | 1.62 | 4.5 | 11.8 | This invention |
| | " | (3) | 1.61 | 4.5 | 11.8 | This invention |
| Paste state (1000%) | (1) | (1) | 1.67 | 5 | 11.9 | This invention |
| | " | (2) | 1.65 | 5 | 11.9 | This invention |
| | " | (3) | 1.61 | 4.5 | 11.8 | This invention |
| Paste state | (1) | (1) | 1.67 | 5 | 11.9 | This invention |

TABLE 4-continued

| | Stored condition | | | | | |
|---|---|---|---|---|---|---|
| | Before preparation | After preparation | Relative sensitivity | Pinhole | Sharpness after running | Remarks |
| (2000%) | " | (2) | 1.64 | 5 | 11.9 | This invention |
| | " | (3) | 1.61 | 4.5 | 11.8 | This invention |
| | (3) | (1) | 1.64 | 5 | 11.9 | This invention |
| | " | (2) | 1.62 | 4.5 | 11.8 | This invention |
| | " | (3) | 1.61 | 4.5 | 11.7 | This invention |
| Paste state (2500%) | (1) | (1) | 1.67 | 3.5 | 10.4 | Comparative |
| | " | (2) | 1.60 | 3 | 9.9 | Comparative |
| | " | (3) | 1.51 | 2.5 | 9.2 | Comparative |
| | (3) | (1) | 1.53 | 3 | 9.6 | Comparative |
| | " | (2) | 1.30 | 2.75 | 9.4 | Comparative |
| | " | (3) | 1.13 | 2.25 | 8.7 | Comparative |

As can be seen from the results in Table 4, it can be understood that deterioration due to oxidation of the developing solution is low when the water content of the raw, solution is 2000% or less.

Example 4

(Preparation of emulsion)

Under acidic atmosphere of pH 3.0, a silver chlorobromide grain containing a rhodium salt in an amount of $10^{-5}$ mole per mole of silver, having an average grain size of 0.20 μm and a monodispersed degree of silver halide composition of 20 and containing 2 mole % of silver bromide was prepared according to the controlled double jet method. The grain growth was carried out in a system in which 30 mg of benzyl adenine was contained per liter of a 1% gelatin aqueous solution. After silver and halide were mixed, 600 mg of 6-methyl-4-hydroxy-l,3,3a,7-tetrazaindene was added to the mixture per mole of silver halide, followed by washing and desalting. Subsequently, sodium thiosulfate was added to effect sulfur sensitization.

To the resulting emulsion were added additives so prepared that the amounts attached became those shown below, and the mixture was coated on a polyethylene terephthalate support having been subjected to subbing treatment used in Example 1.

| Latex polymer: Styrene-butyl acrylate-acrylic acid | |
|---|---|
| Terpolymer | 1.0 g/m² |
| Phenol | 1 mg/m² |
| Saponin | 200 mg/m² |
| Sodium dodecylbenzenesulfonate | 20 mg/m² |
| Tetrazolium compound | *shown below |
| Compound (N) | 40 mg/m² |
| Compound (O) | 50 mg/m² |
| Styrene-maleic acid copolymer | 20 mg/m² |
| Alkali-treated gelatin (isoelectric point: 4.9) | 2.0 g/m² |
| Silver quantity (Ag) | 3.5 g/m² |
| Formalin | 10 mg/m² |

Compound (N)

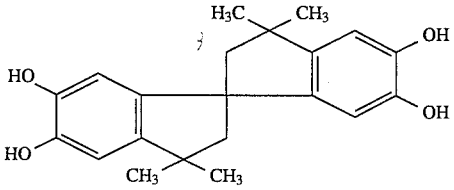

Compound (O)

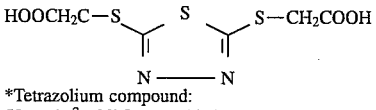

*Tetrazolium compound:
50 mg/m² of T-2 was added to Sample 1.
40 mg/m² of T-3 was added to Sample 2.

The coating solution was previously adjusted to pH 6.5 with sodium hydroxide and then coated. As an emulsion protective film, additives were so prepared that the amounts attached became those shown below, and multilayer coated simultaneously with the emulsion coating solution.

(Preparation method of light-sensitive material F)

To an apparatus charged therein gelatin, sodium chloride and water and heated to 40° C. were added by the double jet method an aqueous silver nitrate solution and a mixed aqueous solution of potassium bromide and sodium chloride to which $2\times10^{-6}$ mole of potassium hexachloroiridate and $4\times 10^{-7}$ mole of potassium hexabromorhodate per mole of silver halide to prepare a silver chlorobromide grain containing 35% silver bromide (width of distribution: 12 %, cubic, grain size: 0.33 μm) while maintaining a pH of 3.0 and a pAg of 7.7, and the grain was returned to pH 5.9 and then desalted by a conventional method.

To the emulsion were added 240 mg of a sensitizing dye (a) shown below and 200 mg of a compound which is a super-sensitizer shown below each per mole of silver halide. Further, the emulsion was subjected to gold sensitization and sulfur sensitization, and after ripening was stopped by adding, per mole of silver halide, 70 mg of 1-phenyl-5-mercaptotetorazone, 1.2 g of 4-hydroxy-6-methyl-l,3,3a,7-tetrazaindene and gelatin, and then, 4 g of hydroquinone, 3 g of potassium bromide, 5 g of saponin, 2 g of a polymer of styrene-maleic acid and 3 g of a high molecular weight polymer latex of ethyl acrylate were added to the emulsion per mole of silver halide. Subsequently, 1-hydroxy-3,5-dichlorotriazine sodium salt and formalin were added to the emulsion to prepare an emulsion layer-forming solution. On the other hand, a protective layer-forming solution was prepared by adding 10 g of potassium bromide and 4 g of sodium 1-decyl-2-(3-isopentyl)succinate-2-sulfonate to 500 g of an aqueous gelatin solution, and then dispersing 100 g of amorphous silica having an average diameter of 5 μm. Then, on a polyethylene terephthalate support which had been subjected to subbing treatment, the emulsion layer-forming solution was coated so as to become a silver amount of 3.5 g/m$^2$ and a gelatin amount of 2.5 g/m$^2$ simultaneously with the protective layer-forming solution so as to become a gelatin amount of 1.0 g/m$^2$.

On the opposite surface of the support on which the above layers were formed, a gelatin solution containing dyes (c) and (d) shown below was previously coated so as to become a gelatin amount of 3.3 g/m$^2$, a dye (c) amount of 180 mg/m$^2$ and a dye (d) amount of 50 mg/m$^2$. This is called Comparative sample 3.

Sensitizing dye (a)

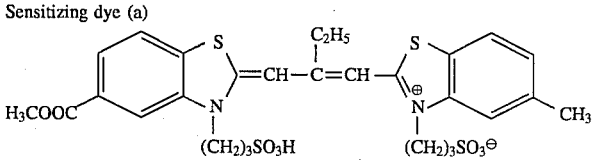

Compound (b)

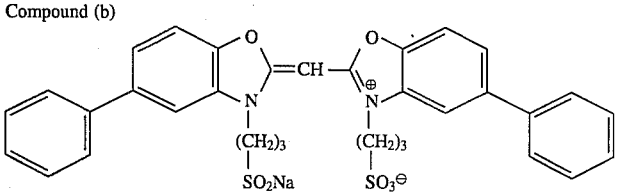

Dye (c)

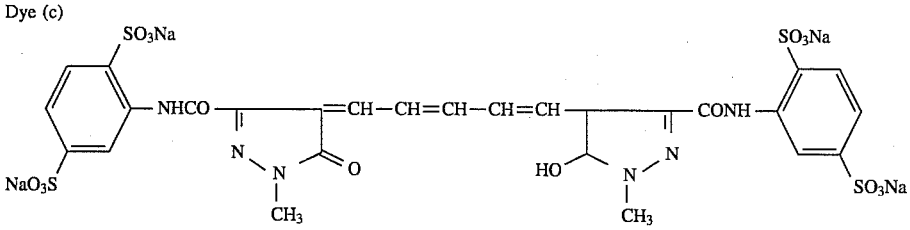

Dye (d)

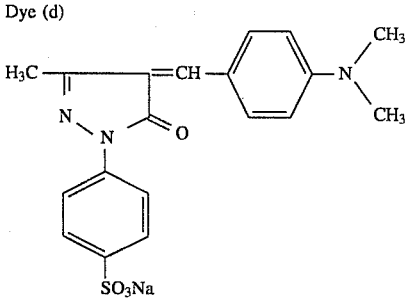

| (Protective film layer) | |
|---|---|
| Fluorinated dioctylsulfosuccinate | 100 mg/m$^2$ |
| Dioctylsulfosuccinate | 100 mg/m$^2$ |
| Matting agent: amorphous silica | 50 mg/m$^2$ |
| Compound (O) | 30 mg/m$^2$ |
| 5-Methylbenzotriazole | 20 mg/m$^2$ |
| Compound (P) | 500 mg/m$^2$ |
| Propyl gallate | 300 mg/m$^2$ |
| Styrene-maleic acid copolymer | 100 mg/m$^2$ |

-continued

| (Protective film layer) | |
|---|---|
| Alkali-treated gelatin (isoelectric point: 4.9) | 1.0 g/m$^2$ |
| Formalin | 10 mg/m$^2$ |

The coating solution was previously adjusted to pH 5.4 with citric acid and then coated.

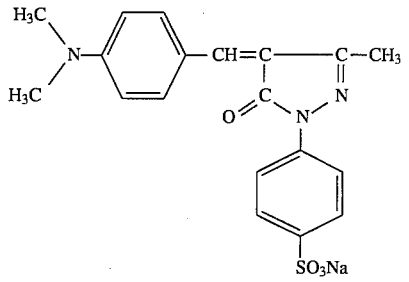

Compound (P)

Next, on the support at the opposite side to the emulsion layer side, a backing layer was provided in the same manner as in Example 2 of Japanese Provisional Patent Publication No. 226143/1990.

D-1 and F-1 were prepared a shown below.

| Developing solution recipe D-1 | |
|---|---|
| D-1-A recipe | |
| Polyethylene glycol (Mn: 600) | 1.3 g |
| 5-Nitroindazole | 0.06 g |
| Phenidone | 0.5 g |
| Hydroquinone | 15 g |
| Sodium sulfite | 22 g |
| D-1-B recipe | |
| Polyethylene glycol (Mn: 600) | 1.4 g |
| 5-Nitroindazole | 0.06 g |
| 1-Phenyl-5-mercaptotetrazole | 0.02 g |
| 5-Methylbenzotriazole | 0.16 g |
| Potassium bromide | 4.5 g |
| Sodium carbonate | 9.3 g |
| Sodium hydroxide | 7.4 g |
| Sodium sulfite | 18 g |

D-1-A and D-1-B represent respective ports and each were granulated and mixed to place in a bag made of a polyethylene. Hereinafter the same.

| Fixing solution recipe F-1 | |
|---|---|
| F-1-A recipe | |
| Water | 4.2 g |
| Ammonium thiosulfate | 135 g |
| Sodium sulfite | 5 g |
| F-1-B recipe | |
| Polyethylene glycol (Mn: 600) | 2.6 g |
| Boric acid | 6.7 g |
| Potassium alum | 20 g |
| Citric acid | 16 g |
| Sodium citrate | 45 g |

D-1 and F-1 were dissolved in an appropriate amount of water, respectively, to prepare a developing solution and a fixing solution. Then, films for evaluation of Samples 1 and 2, and Comparative sample 3 described above were exposed according to a conventional manner, and processed by using an automatic processor GR-27 (trade name manufactured by Konica Corporation) under the following condition

| | (Processing conditions) | |
|---|---|---|
| Step | Temperature (°C.) | Time (sec) |
| Developing | 28 | 30 |
| Fixing | 28 | 20 |
| Washing | 25 | 20 |
| Drying | 45 | 15 |

(Comparative developing solution D-2) Recipe for one liter

| D-2-A | |
|---|---|
| Disodium ethylenediaminetetraacetate dihydrate | 1.025 g |
| Potassium sulfite | 49.5 g |
| Potassium carbonate | 66 g |
| Acidic potassium carbonate | 3 g |
| Diethylene glycol | 50 g |
| Hydroquinone | 15 g |
| Potassium bromide | 2.5 g |
| 5-Methylbenzotriazole | 0.2 g |
| 1-Phenyl-5-mercaptotetrazole | 0.02 g |
| made up to 320 cc with water. | |
| D-2-B | |
| 5-Nitroindazole | 0.11 g |
| Phenidone | |
| Diethylene glycol | 50 g |
| Acetic acid (90%) | 0.3 cc |
| made up to 20 cc with water. | |

(Comparative fixing solution F-2)

| F-2-A | |
|---|---|
| Ammonium thiosulfate | 162.4 g |
| Sodium sulfite | 9.5 g |
| Boric acid | 6.7 g |
| Sodium acetate | 15.9 g |
| Sodium citrate | 2.0 g |
| Acetic acid (90%) | 9.0 g |
| made up to 264 cc with water. | |
| F-2-B | |
| Aluminum sulfate | 15.8 g |
| Sulfuric acid (50%) | 5.75 g |
| made up to 27 cc with water. | |

(Stability evaluation of processing agent)

For evaluating storability of the processing agent, the processing agent stored in a tightly sealed polyethylene bag under a high temperature of 50° C. and a high relative humidity (RH) of 80% for 7 hours was used. By using the developing solution, the maximum density (Dm), sharpness and fog were measured. Further, for evaluating stability of the processing agent at the time of preparation or after preparation, precipitation and turbidity af the time of preparation and after preparation were visually judged by using 5 ranks.

The case when precipitation and turbidity were not caused was designated as Rank 5, and the case when they were caused was designated as Rank 1.

Also, the maximum density (Dm), sharpness and fog after running were measured. The running was carried out as shown in Example 1.

(Evaluation of properties)

The density of the sample after processing was measured by a digital densitometer PDA-65 (trade name, manufactured by Konica Corporation).

Evaluation of sharpness was shown with a gamma value (gamma was a tangent to a straight line). Evaluation of pin hole was carried out with a rank evaluation as shown in Example 1.

The results are shown in Table 5.

TABLE 5

| | | Developing agent | | Lapsed at 23° C., 48% RH for 7 days | | | Lapsed at 50° C., 48% RH for 7 days | | | |
|---|---|---|---|---|---|---|---|---|---|---|
| No. | Sample | Kind | pH | Dm | Sharpness | Fog | Dm | Sharpness | Fog | Remarks |
| 1 | 1 | D-2(L) | 10.40 | 5.6 | 11.2 | 0.01 | 4.3 | 9.7 | 0.03 | Comparative |
| 2 | " | D-1(G) | " | 5.8 | 11.9 | 0.01 | 5.8 | 11.9 | 0.01 | This invention |
| 3 | " | D-1(T) | " | 5.9 | 11.9 | 0.01 | 5.9 | 11.8 | 0.01 | " |
| 4 | 2 | D-2(L) | " | 5.4 | 11.0 | 0.01 | 4.2 | 9.6 | 0.04 | Comparative |
| 5 | " | D-1(G) | " | 5.6 | 11.6 | 0.01 | 5.6 | 11.6 | 0.01 | This invention |
| 6 | " | D-1(T) | " | 5.6 | 11.6 | 0.01 | 5.6 | 11.6 | 0.01 | " |
| 7 | 3 | D-2(L) | " | 5.2 | 10.1 | 0.02 | 5.1 | 10.1 | 0.02 | Comparative |
| 8 | " | D-1(G) | " | 5.2 | 10.1 | 0.02 | 5.1 | 10.1 | 0.02 | " |

| | | Developing agent | | After running | | | Evaluation | Stability of processing agent | | |
|---|---|---|---|---|---|---|---|---|---|---|
| No. | Sample | Kind | pH | Dm | Sharpness | Fog | of pinhole | At preparation | One day after preparation | Remarks |
| 1 | 1 | D-2(L) | 10.40 | 5.4 | 10.4 | 0.02 | 3.5 | 3 | 4 | Comparative |
| 2 | " | D-1(G) | " | 5.8 | 11.9 | 0.01 | 5 | 5 | 5 | This invention |
| 3 | " | D-1(T) | " | 5.9 | 11.9 | 0.01 | 5 | 4.5 | 5 | " |
| 4 | 2 | D-2(L) | " | 5.2 | 10.2 | 0.02 | 3 | 3 | 4 | Comparative |
| 5 | " | D-1(G) | " | 5.6 | 11.5 | 0.01 | 4.5 | 5 | 5 | This invention |
| 6 | " | D-1(T) | " | 5.6 | 11.6 | 0.01 | 4.5 | 4.5 | 5 | " |
| 7 | 3 | D-2(L) | " | 5.1 | 10.0 | 0.03 | 4 | 3 | 4 | Comparative |
| 8 | " | D-1(G) | " | 5.1 | 10.0 | 0.03 | 4 | 5 | 5 | " |

In the brackets, L represents liquid, G represents granule and T represents tablet.

From the results in Table 5, it can be seen that the samples using the processing agent of the present invention have excellent properties and stability of the processing agent as compared with those of the comparative samples.

Example 5

By the method described in Example 4, a silver chlorobromide grain having an average grain size of 0.11 μm and a monodispersed degree of 15 and containing 5 mole % of silver bromide was prepared, and processed, washed, desalted, followed by sulfur sensitization in the same manner as in Example 4.

Subsequently, 6-methyl-4-hydroxy-1,3,3a,7-tetrazaindene was added in an amount of 60 mg per mole of silver halide, and then sodium thiosulfate was added in an amount of 15 mg per mole of silver halide, followed by sulfur sensitization at 60° C. After the sulfur sensitization, 6-methyl-4-hydroxy-1,3,3a,7-tetrazaindene was added as a stabilizer in an amount of 600 mg per mole of silver halide.

To the resulting emulsion were added additives so prepared that the amounts attached became those shown below, and the mixture was coated on a subbing layer of a polyethylene terephthalate support with a thickness of 100 μm having been subjected to subbing treatment according to Example 1 of Japanese Provisional Patent Publication No. 19941/1984.

| Latex polymer: Styrene-butyl acrylate-acrylic acid | |
|---|---|
| Terpolymer | 1.0 g/m$^2$ |
| Tetraphenylphosphonium chloride | 30 mg/m$^2$ |
| Saponin | 200 mg/m$^2$ |
| Polyethylene glycol | 100 mg/m$^2$ |

-continued

| | |
|---|---|
| Hydroquinone | 200 mg/m$^2$ |
| Styrene-maleic acid copolymer | 20 mg/m$^2$ |
| Hydrazine compound | *shown below |
| 5-Methylbenzotriazole | 30 mg/m$^2$ |
| Desensitizing dye (m) | 20 mg/m$^2$ |
| Alkali-treated gelatin (isoelectric point: 4.9) | 1.5 g/m$^2$ |
| Bis(vinylsulfonylmethyl) ether | 15 mg/m$^2$ |
| Silver quantity | 2.8 g/m$^2$ |

Desensitizing dye (M)

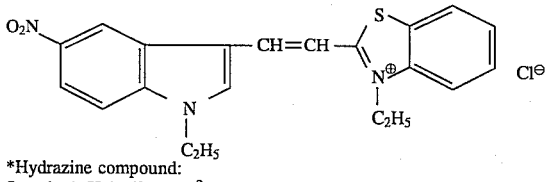

*Hydrazine compound:
Sample 4: H-1; 50 mg/m$^2$,
Sample 5: H-2; 80 mg/m$^2$,
Sample 6: H-3; 20 mg/m$^2$, and
Sample 7: H-4; 17 mg/m$^2$, added, respectively.

(Emulsion layer protective film)

As an emulsion layer protective film, additives were so prepared that the amounts attached became those shown below, and multilayer coated simultaneously with an emulsion.

| | |
|---|---|
| Fluorinated dioctylsulfosuccinate | 200 mg/m$^2$ |
| Sodium dodecylbenzenesulfonate | 100 mg/m$^2$ |
| Matting agent: methyl polymethacrylate (average grain size: 3.5 μm) | 100 mg/m$^2$ |
| Lithium nitrate | 30 mg/m$^2$ |
| Propyl gallate | 300 mg/m$^2$ |
| Sodium 2-mercaptobenzimidazole-5-sulfonate | 30 mg/m$^2$ |
| Alkali-treated gelatin (isoelectric point: 4.9) | 1.3 g/m$^2$ |
| Colloidal silica | 30 mg/m$^2$ |
| Styrene-maleic acid copolymer | 100 mg/m$^2$ |
| Bis(vinylsulfonylmethyl) ether | 15 mg/m$^2$ |

The support at the side opposite to the emulsion layer side was the same as that in Example 4.

(Preparation of granular processing agent) Recipe for one liter

| | |
|---|---|
| (D-3) (one liter recipe of used solution) | |
| D-3-A | |
| Polyethylene glycol (Mn: 600) | 2 g |
| Trisodium phosphate (dodecahydrate) | 26.1 g |
| Hydroquinone | 19.2 g |
| Potassium bromide | 1.2 g |
| 5-Methylbenzotriazole | 0.19 g |
| 2-Mercaptobenzothiazole | 0.025 g |
| Sodium phosphate | 15.6 g |
| N,N-Diethanolamine | 5.5 ml |
| D-3-B | |
| Polyethylene glycol (Mn: 600) | 3 g |
| Disodium ethylenediaminetetraacetate | 1.0 g |
| Sodium pyrosulfite | 63.5 g |
| Sodium chloride | 2.4 g |
| Sodium hydroxide | 33.8 g |
| (D-4) (one liter receipe of used solution) | |
| D-4-A | |
| Polyethylene glycol (Mn: 600) | 3 g |
| Trisodium phosphate (dodecahydrate) | 75 g |
| Hydroquinone | 22.5 g |
| Sodium bromide | 3 g |
| 5-Methylbenzotriazole | 0.25 g |
| 1-Phenyl-5-mercaptotetrazole | 0.08 g |
| Metol (trade name, produced by Agfa Co.) | 0.25 g |
| D-4-B | |
| Polyethylene glycol (Mn: 600) | 2.0 g |
| Disodium ethylenediaminetetraacetate | 1 g |
| Sodium sulfite | 60 g |
| Sodium hydroxide | 8 g |

As a fixing solution, F-1 of Example 3 was used.

In the same manner as in Example 4, the above samples for evaluation were processed.

The processing conditions are shown below.

| | D-3 | | D-4 | |
|---|---|---|---|---|
| Step | Temperature (°C.) | Time (sec) | Temperature (°C.) | Time (sec) |
| Developing | 38 | 30 | 40 | 15 |
| Fixing | 34 | 20 | 35 | 10 |
| Washing | 25 | 20 | normal temperature | 10 |
| Drying | 45 | 15 | 45 | 15 |

As a comparative processing agent, D-5 and D-6 shown below were used.

(Comparative developing solution D-5) (one liter recipe of used solution)

| | |
|---|---|
| Polyethylene glycol (Mn: 600) | 9 g |
| Potassium phosphate | 26.1 g |
| Hydroquinone | 19.2 g |
| Potassium bromide | 1.2 g |
| 5-Methylbenzotriazole | 0.19 g |
| Metol (trade name, produced by Agfa Co.) | 0.35 g |
| 2-Mercaptobenzothiazole | 0.025 g |
| Sodium phosphate | 15.6 g |
| N,N-Diethanolamine | 5.5 ml |
| Disodium ethylenediaminetetraacetate | 1.0 g |
| Sodium pyrosulfite | 63.5 g |
| Sodium chloride | 2.4 g |
| Sodium hydroxide | 33.8 g |
| made up to 500 ml with water. | |

(Comparative developing solution D-6) (one liter recipe of used solution)

| | |
|---|---|
| Polyethylene glycol (Mn: 600) | 9 g |
| Trisodium phosphate (dodecahydrate) | 75 g |
| Hydroquinone | 22.5 g |
| Sodium bromide | 3 g |
| 5-Methylbenzotriazole | 0.25 g |
| 1-Phenyl-5-mercaptotetrazole | 0.08 g |
| Metol (trade name, produced by Agfa Co.) | 0.25 g |
| Disodium ethylenediaminetetraacetate | 1 g |
| Sodium sulfite | 60 g |
| Sodium hydroxide | 8 g |
| made up to 500 ml with water. | |

In the same manner as in Example 4, the stability of the processing agent was evaluated. Also, evaluation of black spot was carried out. Evaluation of black spot was carried out by observing the surface with eyes using a 40-fold magnifying glass. The rank "5" is the best having no black spot, and accompanying with occurrence of black spots, the evaluation was decreased to the rank "4", "3", "2" and "1", successively. The rank "1" is the worst and the rank "3" or more can be practically used. The results are shown in Table 6.

TABLE 6

| No. | Sample | Developing agent Kind | pH | Lapsed at 23° C., 48% RH for 7 days Dm | Sharpness | Fog | Lapsed at 50° C., 48% RH for 7 days Dm | Sharpness | Fog | Remarks |
|---|---|---|---|---|---|---|---|---|---|---|
| 1 | 4 | D-6(L) | 10.5 | 5.4 | 11.1 | 0.01 | 3.0 | 9.6 | 0.04 | Comparative |
| 2 | " | D-4(G) | " | 5.4 | 11.7 | 0.01 | 5.4 | 11.7 | 0.01 | This invention |
| 3 | 5 | D-6(L) | 10.5 | 5.7 | 11.1 | 0.01 | 3.5 | 9.7 | 0.03 | Comparative |
| 4 | " | D-4(G) | " | 5.7 | 11.7 | 0.01 | 5.7 | 11.7 | 0.01 | This invention |
| 5 | 6 | D-5(L) | 11.6 | 5.4 | 11.1 | 0.01 | 5.3 | 9.8 | 0.04 | Comparative |
| 6 | " | D-3(G) | " | 5.7 | 11.7 | 0.01 | 5.7 | 11.7 | 0.01 | This invention |
| 7 | " | D-3(T) | " | 5.7 | 11.7 | 0.01 | 5.7 | 11.7 | 0.01 | " |
| 8 | 7 | D-6(L) | 10.5 | 5.3 | 11.0 | 0.01 | 5.1 | 9.9 | 0.05 | Comparative |
| 9 | " | D-4(G) | " | 5.7 | 11.8 | 0.01 | 5.7 | 11.8 | 0.01 | This invention |
| 10 | " | D-4(T) | " | 5.7 | 11.8 | 0.01 | 5.7 | 11.8 | 0.01 | " |
| 11 | 3 | D-5(L) | 11.6 | 5.2 | 10.1 | 0.02 | 5.1 | 10.1 | 0.02 | Comparative |
| 12 | " | D-3(G) | " | 5.2 | 10.1 | 0.02 | 5.1 | 10.1 | 0.02 | " |
| 13 | " | D-6(L) | 10.5 | 5.2 | 10.1 | 0.02 | 5.1 | 10.1 | 0.02 | " |
| 14 | " | D-4(G) | " | 5.2 | 10.1 | 0.02 | 5.1 | 10.1 | 0.02 | " |

| No. | Sample | Developing agent Kind | pH | After running Dm | Sharpness | Fog | Black spot evaluation | Stability of processing agent At preparation | One month after preparation | Remarks |
|---|---|---|---|---|---|---|---|---|---|---|
| 1 | 4 | D-6(L) | 10.5 | 5.3 | 9.9 | 0.03 | 3 | 3 | 4 | Comparative |
| 2 | " | D-4(G) | " | 5.4 | 11.6 | 0.01 | 5 | 5 | 5 | This invention |
| 3 | 5 | D-6(L) | 10.5 | 5.1 | 9.8 | 0.02 | 3.5 | 3 | 3 | Comparative |
| 4 | " | D-4(G) | " | 5.7 | 11.6 | 0.01 | 4.75 | 5 | 5 | This invention |
| 5 | 6 | D-5(L) | 11.6 | 5.3 | 10.0 | 0.03 | 3 | 3 | 4 | Comparative |
| 6 | " | D-3(G) | " | 5.7 | 11.6 | 0.01 | 5 | 5 | 5 | This invention |
| 7 | " | D-3(T) | " | 5.7 | 11.6 | 0.01 | 4.75 | 5 | 5 | " |
| 8 | 7 | D-6(L) | 10.5 | 5.1 | 9.8 | 0.02 | 3.5 | 3 | 3 | Comparative |
| 9 | " | D-4(G) | " | 5.7 | 11.8 | 0.01 | 4.75 | 5 | 5 | This invention |
| 10 | " | D-4(T) | " | 5.7 | 11.7 | 0.01 | 4.75 | 5 | 5 | " |
| 11 | 3 | D-5(L) | 11.6 | 5.1 | 10.0 | 0.03 | — | 3 | 4 | Comparative |
| 12 | " | D-3(G) | " | 5.1 | 9.9 | 0.03 | — | 5 | 5 | " |
| 13 | " | D-6(L) | 10.5 | 5.1 | 10.0 | 0.03 | — | 3 | 3 | " |
| 14 | " | D-4(G) | " | 5.1 | 10.0 | 0.03 | — | 5 | 5 | " |

From the results in Table 6, it can be seen that even in a light-sensitive material containing a hydrazine compound, the samples of the present invention have excellent properties and stability as compared with those of the comparative samples.

According to the present invention, there can be provided a black-and-white light-sensitive silver halide photographic material which can be prepared easily within a short time, and is excellent in stability at the time of preparation or after preparation, and also excellent in maximum density, sharpness and fog, and a method for processing the same.

Example 6

Storability of a fixing agent was evaluated. As the evaluation, a fixing agent stored under high temperature and high humidity conditions at 50° C. and 80% RH in a polyethylene bag with a sealed state for 7 days was evaluated according to the following method.

A sample in which an unexposed film (2×7 cm) had been developed at 34° C. for 17 seconds was thrown in a fixing solution and clearness property was evaluated by the time until completion of the fixing. Further, stability of a processing solution at preparation of the solution or after preparation of the same was evaluated by observing any precipitation or turbid at preparation or after preparation with eyes and judged to five ranks. The cases where no precipitation nor turbid in are caused, it was judged to rank 5, and the case where they are caused was judged to rank 1. The results are shown in Table 7.

TABLE 7

| Sample No. | Fixing solution Kind | pH of used solution | Lapsed at 23° C., 48% RH for 7 days Fixing ability (25° C.) | Lapsed at 50° C., 48% RH for 7 days Fixing ability (25° C.) | Stability of fixing agent At preparation | One day lapsed after preparation |
|---|---|---|---|---|---|---|
| 1 | F-2(L) | 4.70 | 13 sec. | 28 sec. | 3 | 4 |
| " | F-1(G) | " | 12 sec. | 12 sec. | 5 | 5 |
| " | F-1(T) | " | 11 sec. | 11 sec. | 4 | 5 |
| 2 | F-2(L) | " | 14 sec. | 30 sec. | 3 | 4 |
| " | F-1(G) | " | 11 sec. | 11 sec. | 5 | 5 |
| " | F-1(T) | " | 11 sec. | 11 sec. | 4 | 5 |
| 4 | F-2(L) | " | 15 sec. | 25 sec. | 3 | 4 |
| " | F-1(G) | " | 11 sec. | 11 sec. | 5 | 5 |
| " | F-1(T) | " | 11 sec. | 11 sec. | 4 | 5 |
| 5 | F-2(L) | " | 14 sec. | 24 sec. | 3 | 3 |
| " | F-1(G) | " | 11 sec. | 11 sec. | 5 | 5 |
| " | F-1(T) | " | 10 sec. | 10 sec. | 4 | 5 |
| 6 | F-2(L) | " | 14 sec. | 20 sec. | 3 | 4 |
| " | F-1(G) | " | 11 sec. | 11 sec. | 5 | 5 |
| " | F-1(T) | " | 11 sec. | 11 sec. | 4 | 5 |
| 7 | F-2(L) | " | 14 sec. | 21 sec. | 3 | 4 |
| " | F-1(G) | " | 11 sec. | 11 sec. | 5 | 5 |
| " | F-1(T) | " | 11 sec. | 11 sec. | 5 | 5 |

TABLE 7-continued

| Sample No. | Fixing solution Kind | pH of used solution | Lapsed at 23° C., 48% RH for 7 days Fixing ability (25° C.) | Lapsed at 50° C., 48% RH for 7 days Fixing ability (25° C.) | Stability of fixing agent At preparation | One day lapsed after preparation |
|---|---|---|---|---|---|---|
| 3 | F-2(L) | " | 13 sec. | 18 sec. | 3 | 4 |
| " | F-1(G) | " | 11 sec. | 12 sec. | 5 | 5 |
| " | F-1(T) | " | 11 sec. | 11 sec. | 4 | 5 |

F-1(L) was a liquid state fixing agent, F-1(G) was a granular state fixing agent and F-1(T) was a tablet state fixing agent, respectively.

F-1(L) was a liquid state fixing agent, F-1(G) was a granular state fixing agent and F-1(T) was a tablet state fixing agent, respectively.

TABLE 8

| No. | Evaluated film | Developing agent | Replenishing amount (ml/25 × 30 cm) | Developing time | Developing temperature | Before running | After running | Remarks |
|---|---|---|---|---|---|---|---|---|
| 1 | 1 | D-2(L) | 15 | 15" | 28° C. | 11.2 | 9.3 | Comparative |
| 2 | " | " | 18 | 15" | " | 11.2 | 10.0 | " |
| 3 | " | " | 30 | 15" | " | 11.2 | 10.4 | " |
| 4 | " | " | 18 | 20" | " | 11.2 | 10.3 | " |
| 5 | " | " | " | 25" | " | 11.2 | 10.4 | " |
| 6 | " | D-1(G) | 15 | 15" | " | 11.8 | 11.5 | This invention |
| 7 | " | " | 18 | 15" | " | 11.8 | 11.7 | " |
| 8 | " | " | 30 | 15" | " | 11.8 | 11.9 | " |
| 9 | " | " | 18 | 20" | " | 11.8 | 11.8 | " |
| 10 | " | " | " | 25" | " | 11.8 | 11.8 | " |
| 11 | 6 | D-5(L) | 18 | 15" | 38° C. | 11.0 | 9.7 | Comparative |
| 12 | " | " | 30 | 15" | " | 11.0 | 10.0 | " |
| 13 | " | " | 18 | 20" | " | 11.0 | 10.2 | " |
| 14 | " | " | " | 25" | " | 11.0 | 10.3 | " |
| 15 | " | D-3(G) | 18 | 15" | " | 12.0 | 12.0 | This invention |
| 16 | " | " | 30 | 15" | " | 12.0 | 12.0 | " |
| 17 | " | " | 18 | 20" | " | 12.0 | 12.0 | " |
| 18 | " | " | " | 25" | " | 12.0 | 12.0 | " |
| 19 | 7 | D-6(L) | 18 | 15" | 40° C. | 11.1 | 9.5 | Comparative |
| 20 | " | " | 30 | 15" | " | 11.1 | 9.8 | " |
| 21 | " | " | 18 | 20" | " | 11.1 | 10.3 | " |
| 22 | " | " | " | 25" | " | 11.1 | 10.5 | " |
| 23 | " | D-4(G) | 18 | 15" | " | 12.1 | 12.0 | This invention |
| 24 | " | " | 30 | 15" | " | 12.1 | 12.1 | " |
| 25 | " | " | 18 | 20" | " | 12.1 | 12.1 | " |
| 26 | " | " | " | 25" | " | 12.1 | 12.1 | " |

From the results in Table 7, it can be seen that the solid type processing agents of the present invention have excellent storability and stability during preparation of the processing solution as compared with those of the liquid type processing agents.

Example 7

Relationships between deterioration degree of clearness, and a replenishing amount of a developing solution and a developing time are shown in Table 8. As an automatic processor, GR-26SR (trade name, manufactured by KONICA CORPORATION) was used and as a fixing agent, F-1 (G) (granular state fixing agent) was used. Other than the above, the experiment was carried out in the same manner as in Example 1.

From the results in Table 8, it can be seen that the developing solutions of the present invention prepared from a solid (granule kit) agent show extremely little deterioration in sharpness before and after running even when the developing time is shortened or the supplemental amount is diminished whereby stable processing can be done as compared to the developing solutions prepared from a liquid agent kit.

We claim:

1. A method for processing an exposed black-and-white light-sensitive silver halide photographic material containing a tetrazolium compound or a hydrazine compound, which method comprises:

developing said photographic material with a developing solution, wherein said developing solution is prepared from a processing agent which is in granule or tablet form, said processing agent comprising a mixture of a polyhydroxybenzene and at least one compound selected from the group consisting of 1-phenyl-3-pyrazolidone, 1-phenyl-4,4-dimethyl- 3-pyrazolidone, 1-phenyl-4-methyl-4-hydroxymethyl-3-pyrazolidone, 1-phenyl-4,4-dihydroxymethyl-3-pyrazolidone and N-methyl-p-aminophenol sulfate, and containing water in an amount of 2000% by weight or less based on an amount of said polyhydroxybenzene.

2. The method of claim 1, wherein said form is granule.

3. The method of claim 1, wherein said form is a tablet.

4. The method of claim 1, wherein said processing agent contains water in an amount of 400% or less by weight based on the amount of said polyhydroxybenzene developing agent.

5. The method of claim 4, wherein said processing agent is in a form of a tablet.

6. The method of claim 4, wherein said processing agent contains water in an amount of 40% or less by weight based on the amount of said polyhydroxybenzene developing agent.

7. The method of claim 6, wherein said processing agent is in a form of a tablet.

8. The method of claim 1, wherein said photographic material is further processed by a fixing solution prepared by dissolving a fixing agent.

9. The method of claim 8, wherein said fixing agent comprises a thiosulfate compound and water in an amount of 300% or less by weight based on an amount of said thiosulfate compound.

10. The method of claim 1, wherein said processing agent further comprises a sulfite.

11. The method of claim 1, wherein said hydrazine compound is represented by the following formula (H):

$$A-\underset{\underset{A_1}{|}}{N}-\underset{\underset{A_2}{|}}{N}-G-R \qquad \text{(H)}$$

wherein A represents an aryl group or a heterocyclic group having at least one sulfur atom or oxygen atom; G represents a $-(C(O))_n-$ group, a sulfonyl group, a sulfoxy group, —P(O) (R)— group or an iminomethylene group; n represents an integer of 1 or 2; $A_1$ and $A_2$ both represent hydrogen atoms, or one of $A_1$ and $A_2$ represents a hydrogen and the other represents an alkylsulfonyl group, or an acyl group; and R represents a hydrogen atom, an alkyl group, an aryl group, an alkoxy group, an aryloxy group, an amino group, a carbamoyl group, an oxycarbonyl group or $-O-R_4$ group where $R_4$ represents an alkyl group or a saturated heterocyclic group.

12. The method of claim 11, wherein said processing agent contains water in an amount of 40% or less by weight based on the amount of said polyhydroxybenzene developing agent.

* * * * *